US011808186B2

(12) United States Patent
Ostromecki et al.

(10) Patent No.: US 11,808,186 B2
(45) Date of Patent: Nov. 7, 2023

(54) SURFACE COMPONENT FOR VEHICLE EXHAUST SYSTEM

(71) Applicant: TENNECO AUTOMOTIVE OPERATING COMPANY INC., Lake Forest, IL (US)

(72) Inventors: Gabriel Ostromecki, Ann Arbor, MI (US); Stephen Thomas, Laingsburg, MI (US); Asela Benthara-Wadumesthrige, Ann Arbor, MI (US); Frederick M. Baumgartner, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 167 days.

(21) Appl. No.: 17/318,489

(22) Filed: May 12, 2021

(65) Prior Publication Data

US 2021/0285349 A1 Sep. 16, 2021

(51) Int. Cl.
*F01N 13/08* (2010.01)
*F01N 1/00* (2006.01)

(52) U.S. Cl.
CPC ..... *F01N 1/006* (2013.01); *F01N 13/08* (2013.01); *F01N 2470/20* (2013.01)

(58) Field of Classification Search
CPC . F01N 1/023; F01N 1/026; F01N 1/14; F01N 2470/20
See application file for complete search history.

(56) References Cited

U.S. PATENT DOCUMENTS

| | | | |
|---|---|---|---|
| 2,323,891 | A | 7/1943 | Blanchard |
| 5,493,080 | A | 2/1996 | Moss |
| 6,378,471 | B1 | 4/2002 | Yamada et al. |
| 7,556,123 | B2 | 7/2009 | Ido et al. |
| 8,881,863 | B2 | 11/2014 | Abram et al. |

(Continued)

FOREIGN PATENT DOCUMENTS

| | | | |
|---|---|---|---|
| CN | 104074585 | A | 10/2014 |
| CN | 210509347 | U | 5/2020 |

(Continued)

OTHER PUBLICATIONS

Machine translation of DE 112015005030 T5, accessed Mar. 8, 2023 (Year: 2023).*

(Continued)

*Primary Examiner* — Jonathan R Matthias
(74) *Attorney, Agent, or Firm* — McGarry Bair PC

(57) ABSTRACT

A vehicle exhaust system and method of minimizing a leaked mass flow comprising an exhaust component defining a central axis and having an inner surface and an outer surface, such that the inner surface defines a primary exhaust gas flow path extending along the central axis from an inlet to an outlet, and a surface component having a hood spaced from the exhaust component to define a reservoir having a reservoir volume (V), the reservoir comprising a reservoir inlet fluidly coupled to the primary exhaust gas flow path and defining an inlet area (A), and a reservoir outlet fluidly coupled to an outside environment. The reservoir volume and inlet area having a defined relationship. The reservoir volume and a mass flow through the inlet area having a defined relationship.

19 Claims, 19 Drawing Sheets

(56) References Cited

U.S. PATENT DOCUMENTS

| | | | | |
|---|---|---|---|---|
| 2004/0104071 | A1 | 6/2004 | Wahlstrom et al. | |
| 2008/0041657 | A1* | 2/2008 | Ido | G10K 11/172 181/255 |
| 2008/0230306 | A1 | 9/2008 | Ichikawa | |
| 2018/0347440 | A1 | 12/2018 | Shimizu et al. | |
| 2021/0108544 | A1* | 4/2021 | Boennen | F01N 13/1844 |
| 2021/0285349 | A1 | 9/2021 | Ostromecki et al. | |

FOREIGN PATENT DOCUMENTS

| | | | |
|---|---|---|---|
| DE | 112015005030 | T5 | 8/2017 |
| JP | 2004169622 | A | 6/2004 |
| JP | 4771546 | B2 | 9/2011 |
| JP | 2012225210 | A | 11/2012 |
| JP | 2015222056 | A | 12/2015 |

OTHER PUBLICATIONS

Notification of Transmittal of the International Search Report and the Written Opinion of the International Searching Authority for Counterpart PCT/US2022/026948, dated Aug. 8, 2022, 11 Pages.

* cited by examiner

SURFACE COMPONENT FOR VEHICLE EXHAUST SYSTEM

TECHNICAL FIELD

The present disclosure relates to a vehicle exhaust system. More specifically, the present disclosure relates to a pulsation surface component for the vehicle exhaust system.

BACKGROUND

A vehicle exhaust system directs exhaust gas generated by an internal combustion engine to external environment. The exhaust system can include various components, such as pipes, converters, catalysts, filters, and the like. During operation of the exhaust system, as a result of resonating frequencies, the components may generate undesirable noise. Different methods have been employed in various applications to address this issue. The components, such as mufflers, resonators, valves, and the like, have been incorporated into the exhaust system to attenuate certain resonance frequencies generated by the engine or the exhaust system. However, such additional components are expensive and increase weight of the exhaust system. Also, adding new components into the exhaust system may introduce new sources of undesirable noise generation.

Acoustic attenuation is a sound attenuating method where an opening can be provided on an exhaust pipe. The opening provides a secondary exhaust leak path for sound to exit the exhaust pipe. The acoustic attenuation utilizes a series of holes to allow sound waves to exit the exhaust pipe while limiting flow of the exhaust gas through the holes. In some instances, the holes may be covered with a microperforated material. In order to achieve a desired noise attenuation, the holes have to be relatively large in size. While the holes can provide a path for sound to exit the exhaust pipe and minimize unwanted noise, the openings can also provide a path along which fluids can flow out of the exhaust pipe.

SUMMARY

In an aspect of the present disclosure, a vehicle exhaust system comprising an exhaust component defining a central axis and having an inner surface and an outer surface, such that the inner surface defines a primary exhaust gas flow path extending along the central axis from an inlet to an outlet, and a surface component having a hood spaced from the exhaust component to define a reservoir having a reservoir volume (V), the reservoir comprising a reservoir inlet fluidly coupled to the primary exhaust gas flow path and defining an inlet area (A), and a reservoir outlet fluidly coupled to an outside environment; wherein a minimum reservoir volume (Vmin) to inlet area (A) ratio is greater than or equal to 100 mm:(100 mm≤V_min/A).

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

Figure 1:
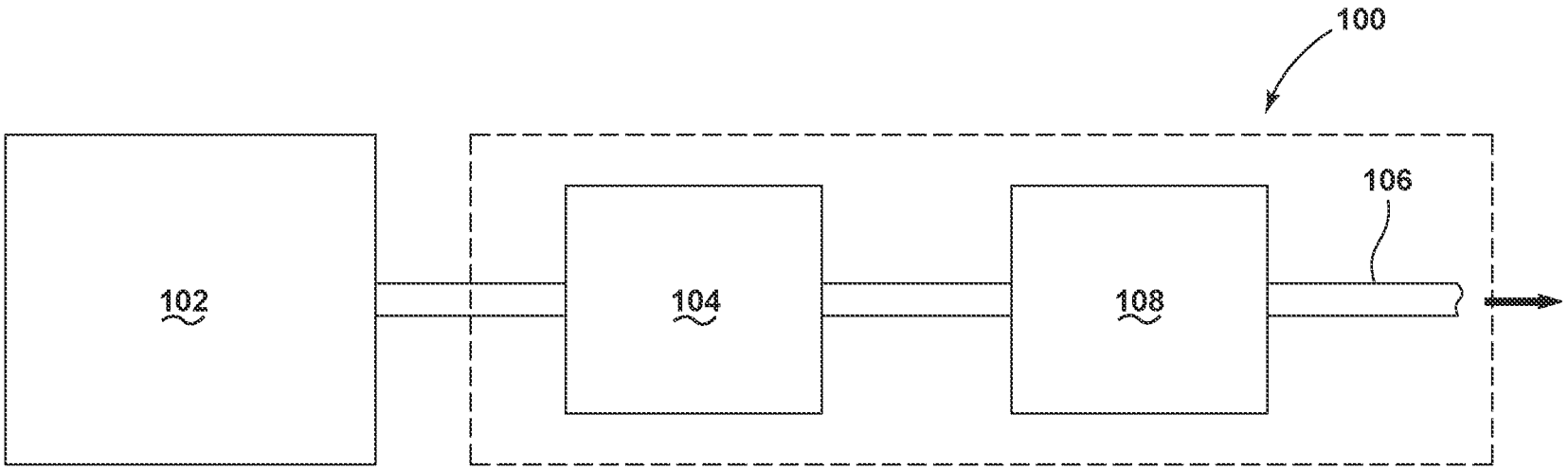
FIG. 1 is a schematic representation of a vehicle exhaust system, according to an aspect of the present disclosure.

Aspects of the disclosure herein relate to a vehicle exhaust system with openings. More specifically, the disclosure relates to a surface component provided at the openings to provide a holding reservoir for holding fluids that have passed into the reservoir until the fluids can be drawn back into the vehicle exhaust system. The surface component described herein, can also be referred to as a pulsation surface component, as pulses in a flow of gas through the vehicle exhaust system cause fluids to move in and out of the reservoir. Some of the openings described herein can be for acoustic attenuation technology utilized to attenuate certain resonance frequencies generated by the engine or the exhaust system. However, any openings are contemplated that enable the temporary holding of a gas until it is drawn back into the vehicle exhaust system.

As used herein, the term "forward" or "upstream" refers to moving in a direction toward the engine inlet, or a component being relatively closer to the engine inlet as compared to another component. The term "aft" or "downstream" used in conjunction with "forward" or "upstream" refers to a direction toward the rear or outlet of the engine relative to the engine centerline. Additionally, as used herein, the terms "radial" or "radially" refer to a dimension extending between a center longitudinal axis of the engine and an outer engine circumference. Furthermore, as used herein, the term "set" or a "set" of elements can be any number of elements, including only one.

All directional references (e.g., radial, axial, proximal, distal, upper, lower, upward, downward, left, right, lateral, front, back, top, bottom, above, below, vertical, horizontal, clockwise, counterclockwise, upstream, downstream, aft, etc.) are only used for identification purposes to aid the reader's understanding of the present disclosure, and do not create limitations, particularly as to the position, orientation, or use of the disclosure. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. Furthermore, it should be understood that the term cross section or cross-sectional as used herein is referring to a section taken orthogonal to the centerline and to the general coolant flow direction in the hole. The exemplary drawings are for purposes of illustration only and the dimensions, positions, order and relative sizes reflected in the drawings attached hereto can vary.

The following description of the preferred embodiment(s) is merely exemplary in nature and is in no way intended to limit the invention, its application, or uses. Referring now to the drawings in which like reference numerals designate like or corresponding parts throughout the several views, there is shown in FIG. 1. Referring to FIG. 1, a schematic representation of a vehicle exhaust system 100 is illustrated. The vehicle exhaust system 100 will be hereinafter interchangeably referred to as the "system 100". The system 100 is fluidly coupled to an engine 102. The engine 102 can be any internal combustion engine powered by a fuel, such as diesel, gasoline, natural gas, and/or a combination thereof. Accordingly, the system 100 receives exhaust gas generated by the engine 102.

The system 100 can include a number of downstream exhaust components 104 fluidly coupled to the engine 102. The exhaust components 104 can include a number of systems/components (not shown), such as a Diesel Oxidation Catalyst (DOC), a Diesel Exhaust Fluid (DEF) unit, a Selective Catalytic Reduction (SCR) unit, a particulate filter, an exhaust pipe, an active valve, a passive valve and the like. The exhaust components 104 can be mounted in various different configurations and combinations based on application requirements and/or available packaging space. The exhaust components 104 are adapted to receive the exhaust gas from the engine 102 and direct the exhaust gas to the external atmosphere via a tailpipe 106. The exhaust components 104 are adapted to reduce emissions and control noise.

The system 100 can also include an exhaust component 108. In some embodiments, the exhaust component 108 can be part of an exhaust pipe. The exhaust component 108 can perform noise attenuation. The exhaust component 108 is provided in fluid communication with the exhaust components 104 and the tailpipe 106. In the illustrated embodiment, the exhaust component 108 is disposed downstream of the exhaust components 104 and upstream of the tailpipe 106. In other embodiments, the exhaust component 108 can be disposed in any sequence with respect to each of the exhaust components 104 and/or the tailpipe 106, based on application requirements. The exhaust component 108 can be adapted to dampen resonance frequencies generated during operation of the engine 102 and the system 100.

Figure 2:
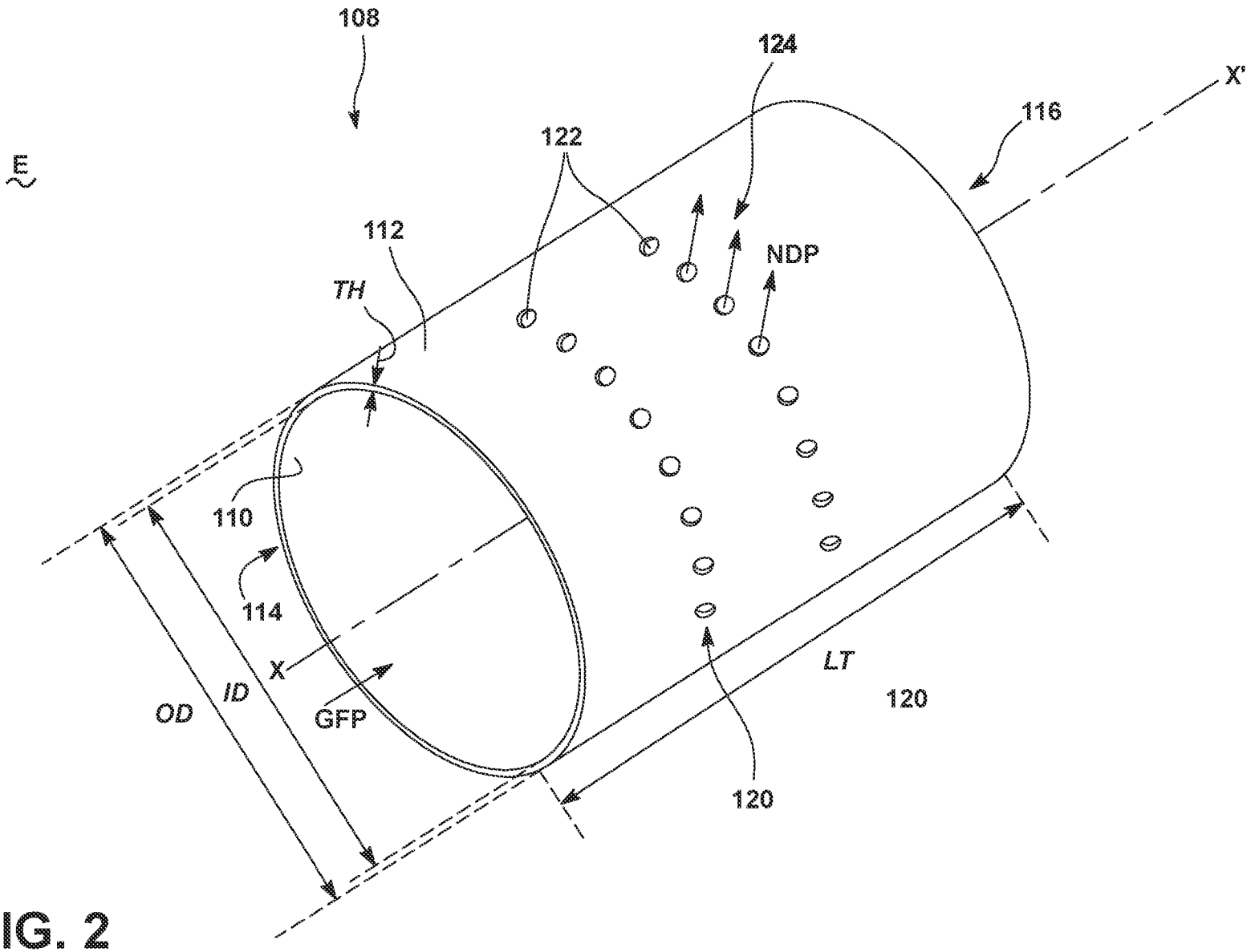
FIG. 2 is a perspective view of an exhaust component of the vehicle exhaust system of FIG. 1, according to an aspect of the present disclosure.

Referring to FIG. 2, a perspective view of an exemplary exhaust component. The exhaust component can be any one or more of the exhaust components 104 and/or any portion of the system 100, such as the exhaust pipe, the tailpipe 106, and the like. By way of non-limiting example, the exhaust component will be referred to herein as the exhaust component 108. The exhaust component 108 has a substantially hollow and cylindrical configuration defining a central axis X-X'. Accordingly, the exhaust component 108 includes an inner surface 110 and an outer surface 112. The exhaust component 108 also includes an inlet end 114 and an outlet end 116. The outlet end 116 is disposed opposite and spaced apart with respect to the inlet end 114 along the central axis X-X'. The exhaust component 108 defines a primary exhaust gas flow path (GFP) along the inner surface 110 between the inlet end 114 and the outlet end 116 along the central axis X-X'. The primary exhaust gas flow path (GFP) is separated from an exterior environment (E) by the exhaust component 108. An outer diameter (OD), an inner diameter (ID), a thickness (TH), and a length (LT) of the exhaust component 108 can be varied as per application requirements.

The exhaust component 108 can include at least one set of openings 120. The at least one set of openings 120 can be multiple sets of openings as illustrated, each set including at least one opening 122. It should be understood that based on application requirements, the number of openings 122 in each of the sets of openings 120 can vary from one to several. The openings 122 extend through each of the inner surface 110 and the outer surface 112 and are spaced apart from each other. In the illustrated embodiment, each opening 122 has a substantially circular configuration. In other embodiments, the at least one opening 122 can have any other configuration, such as rectangular, triangular, elliptical, circular, oval, polygonal, and the like. The at least one opening 122 provides a noise damper path (NDP) for dampening resonance frequencies generated by the engine or the exhaust system. Sound waves can exit the exhaust pipe through the at least one opening. In some instances, the at least one opening can be covered with a microperforated material.

A number of the openings 122 can vary as per application requirements. The shape and dimensions of each opening 122 can vary as per application requirements. The openings 122 can expose an interior of the exhaust component 108 to atmosphere at multiple locations to break up one or more acoustic modes.

Figure 3:
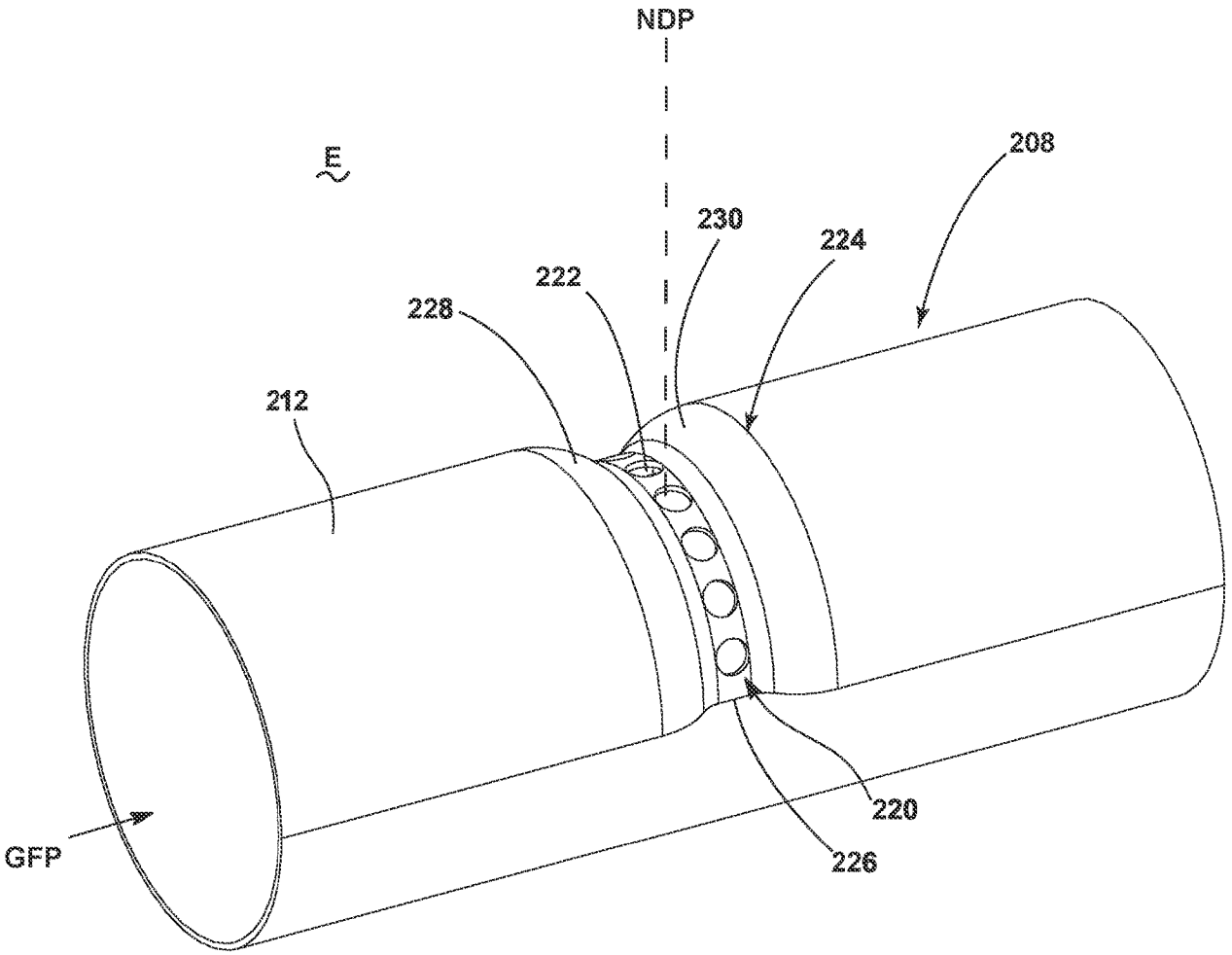
FIG. 3 is a perspective view of a variation of an exhaust component of the vehicle exhaust system of FIG. 1, according to another aspect of the present disclosure.

FIG. 3 is an exemplary exhaust component 208 having at least one ridge 224 with a set of openings 120 including multiple circular openings 222 provided at a center portion 226 of the ridge 224. The ridge 224 can allow control of one or more acoustic modes (e.g., standing wave) within the exhaust component 208. The ridge 224 can extend at least partly along a circumference of the exhaust component 208. The ridge 224 can include a first portion 228 angularly extending inwardly from an outer surface 212 of the exhaust component. The ridge 224 can further include a second portion 230 disposed downstream of the first portion 228. The second portion 230 angularly extends inwardly from the outer surface 212 and can meet the first portion 228 at the center portion 226.

Figure 4:
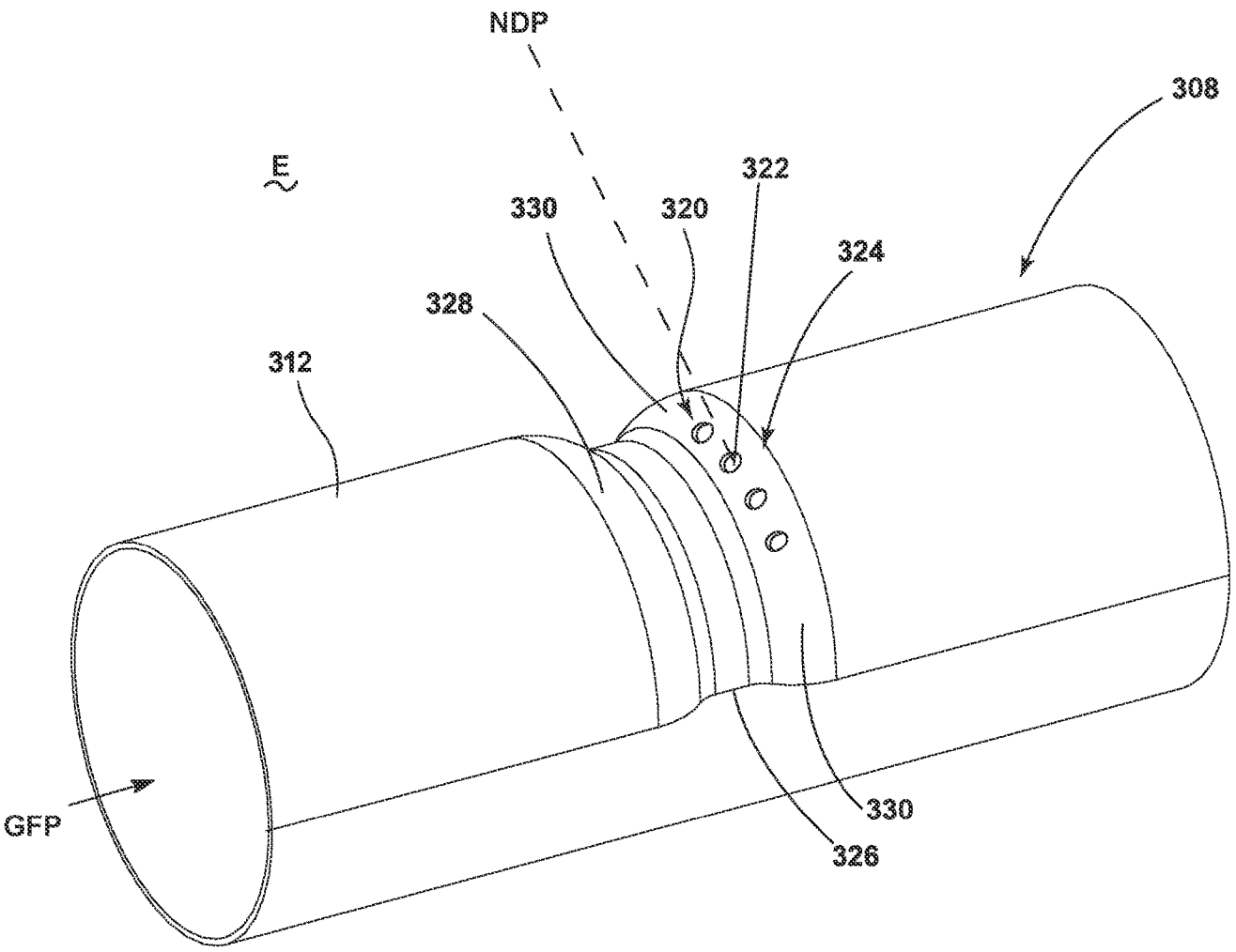
FIG. 4 is a perspective view of another variation of an exhaust component of the vehicle exhaust system of FIG. 1, according to yet another aspect of the present disclosure.

FIG. 4 is an exemplary exhaust component 308 having at least one ridge 324 with multiple openings 322. The ridge 324 can extend at least partly along a circumference of the exhaust component 308. The ridge 324 can include a first portion 328 and a second portion 330 disposed opposite of each other as described previously herein. In one example, the second portion 328 can include the sets of openings 320 with multiple circular openings 322 as illustrated. The noise damper path (NDP) can be angled as illustrated by the ridge 324 orientation.

Figure 5:
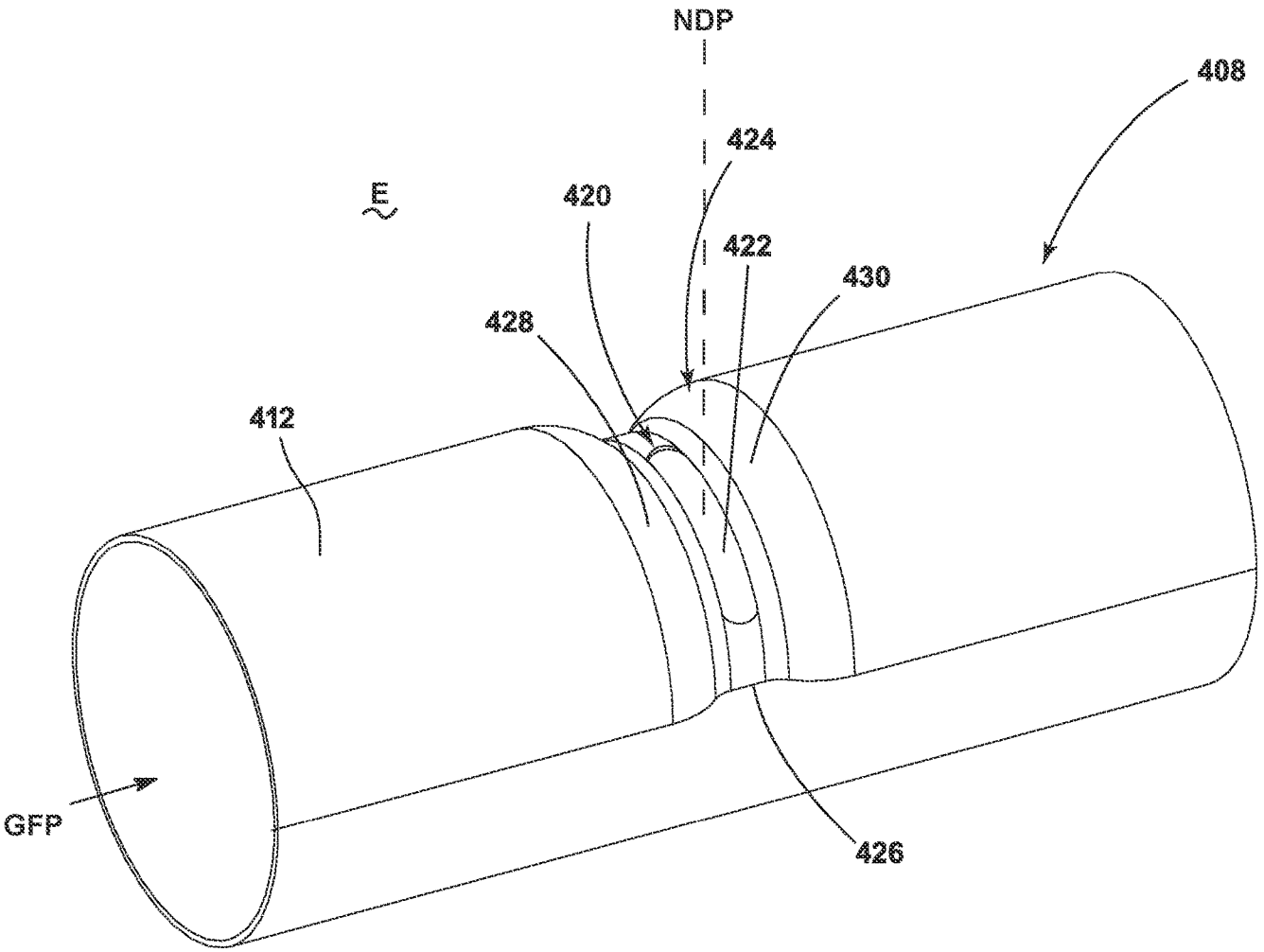
FIG. 5 is a perspective view of yet another variation of an exhaust component of the vehicle exhaust system of FIG. 1, according to another aspect of the present disclosure.

FIG. 5 is an exemplary exhaust component 408 having at least one ridge 424 with a single rectangular opening 422 located at a center portion 426 of the ridge 424. Longer legs of the rectangle can extend along a circumference of the exhaust component 408.

FIGS. 2, 3, 4, and 5 are exemplary exhaust components 208, 308, 408, and 508. It should be understood that aspects of each can be combined to form any type of exhaust component for use in the system 100 as described herein, including but not limited to multiple ridges with varying sets of openings. The exhaust component can be any one or more of the exhaust components and/or any portion of the system 100, such as the exhaust pipe, the tailpipe, and the like.

Figure 6:
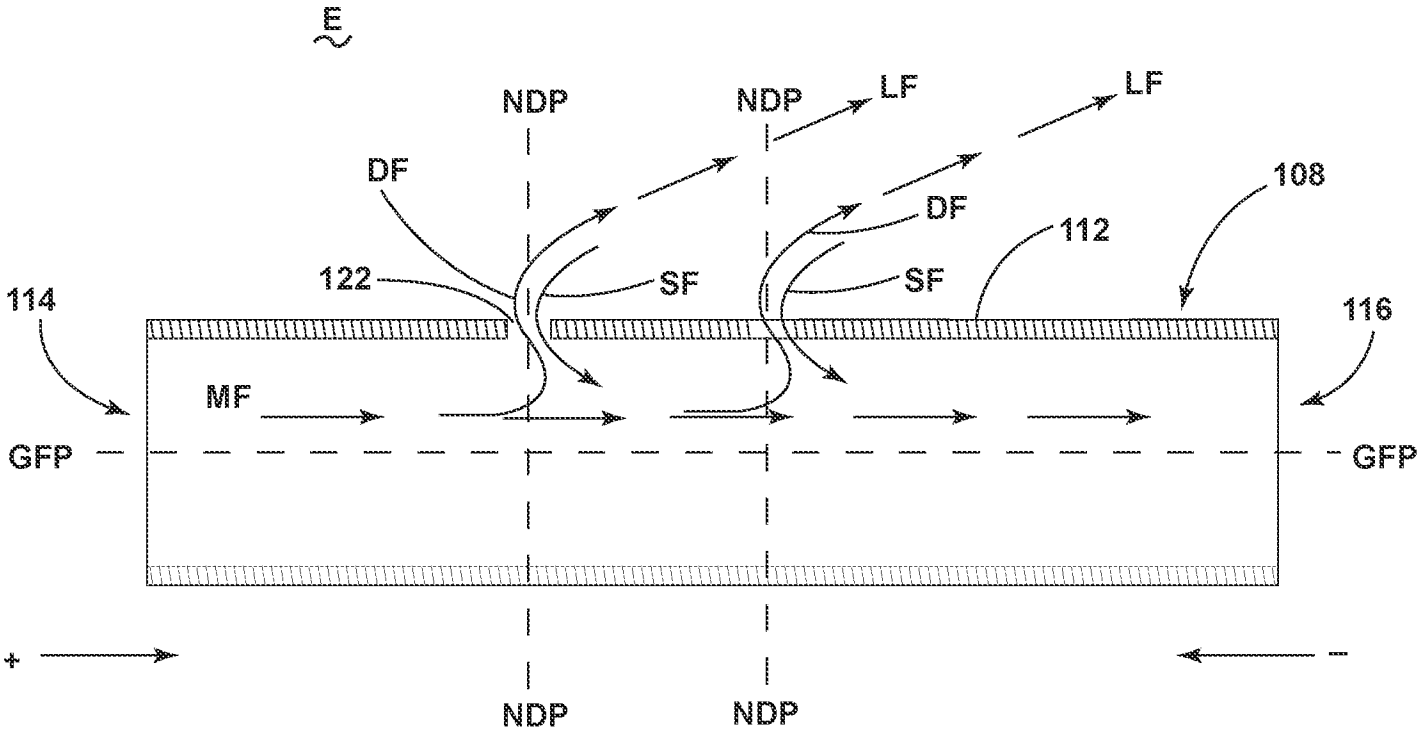
FIG. 6 is a cross-sectional view of the exhaust component of FIG. 3, according to an aspect of the present disclosure.

FIG. 6 is a schematic cross-sectional view of exhaust component 108 during operation. A primary mass flow (MF) travels along the primary exhaust gas flow path (GFP). The primary mass flow (MF) can travel in both a positive (+) and a negative (−) direction. In some scenarios, during operation it has been found that when the opening 122 in the exhaust component 108 is provided, the positive (+) and negative (−) flow of the primary mass flow (MF) can cause positive (+) and negative (−) mass flow along the noise damper path (NDP). While illustrated as straight up and down, it should be understood that the noise damper path (NDP) can be angled in any orientation by forming the openings 122 themselves at an angle, or by utilizing ridges, by way of non-limiting example ridge 324 as described herein. The positive (+) mass flow along the noise damper path (NDP) is referred to herein as a diverted flow (DF) while the negative mass (−) flow along the noise damper path (NDP) is referred to herein as a suction flow (SF). A total amount of fluid that ends up actually leaving the primary mass flow (MF) is generally referred to herein as a leaked mass flow (LF). The leaked mass flow is equal to a difference between an initial mass flow of fluid having left the exhaust component 108 with the diverted flow (DF) and whatever portion of the initial mass flow of fluid that is drawn back in via the suction flow (SF). For example if 12 kg/hr of fluid leaves the exhaust component 108 with the diverted flow (DF) and 9 kg/hr of that fluid re-enters the exhaust component with the suction flow (SF), the leaked mass flow (LF) is 3 kg/hr.

It has been found that fluids flowing along the noise damper path (NDP) occur primarily during low frequency pulsating flow situations, by way of non-limiting example in engines having 1-6 explosions per one engine cycle, and in idle or close to idle engine running conditions or run-down conditions. In other words, the mass flow of fluids along the noise damper path (NDP) can occur in low revolutions per minute (RPM) scenarios. While some of the diverted flow (DF) will be drawn back into the exhaust component 108 with the suction flow (SF), to ensure that little to none of the diverted flow (DF) becomes a leaked mass flow (LF), a pulsation surface component as described further herein can be provided. While most figures show a noise damper path (NDP) normal to the primary exhaust gas flow path (GFP), the openings 122 can be orientated in an upstream, downstream or lateral direction depending on the implementation as is illustrated in FIG. 4.

Figure 7:
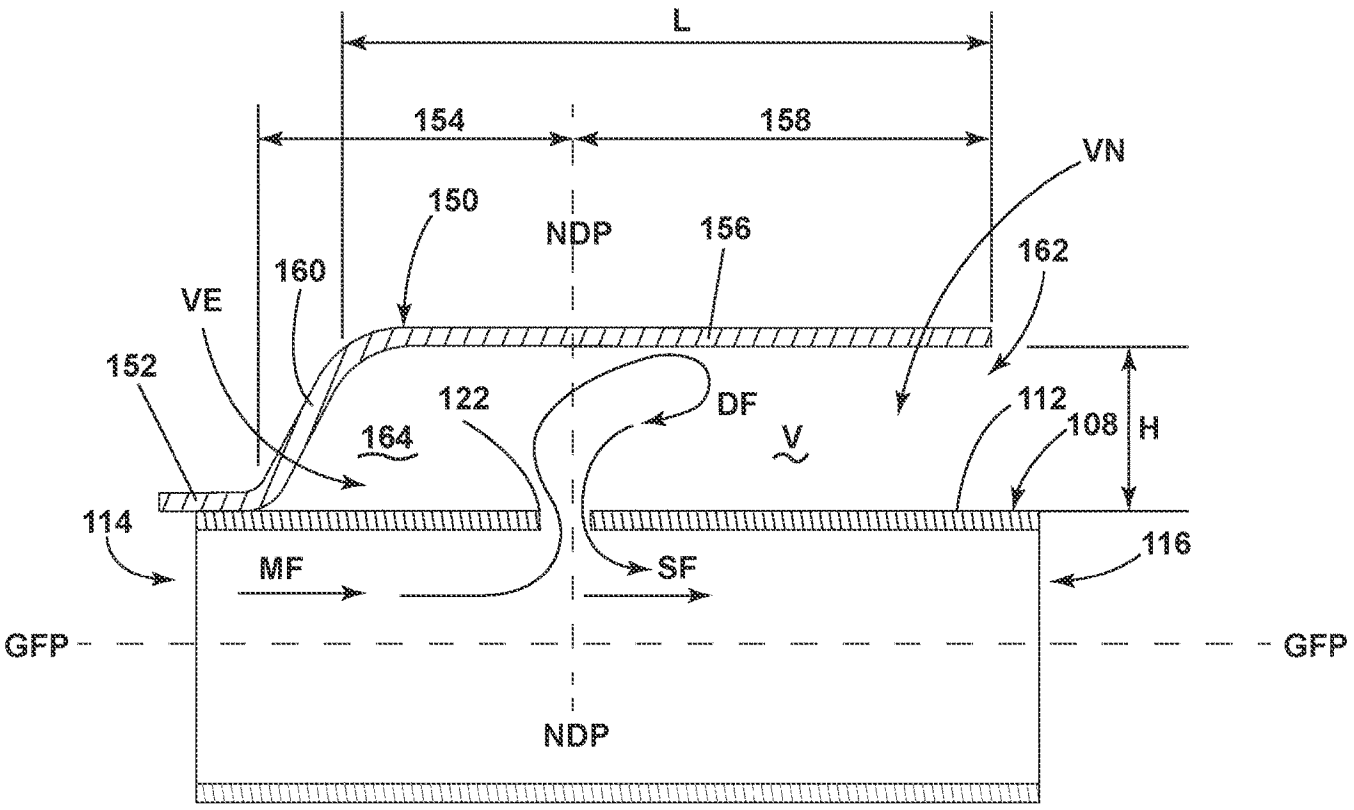
FIG. 7 is a cross-sectional view of the exhaust component if FIG. 3 with a surface component, according to an aspect of the present disclosure.

FIG. 7 illustrates a cross-section of exhaust component 108 with a pulsation surface component, referred to herein simply as a surface component 150, according to the disclosure herein. For clarity one of the openings 122 has been removed. While a single set of openings is illustrated, it should be understood that any number of sets of openings can be provided (FIG. 2) at the outer surface 112 and that the second dimension 158 is downstream the set of openings furthest downstream the flange 152. The surface component 150 is connected to the exhaust component 108 at a flange 152 spaced upstream from the set openings 120 a first dimension 154. The surface component 150 can include a hood 156 spaced radially from the outer surface 112 at a height (H). The hood 156 can extend parallel to the outer surface 112 and downstream of the set of openings 120 a second dimension 158. A base or end portion 160 can connect the flange 152 to the hood 156 such that the surface component 150 is closed at the end portion 160. The hood 156 can extend a length (L) and be spaced from the outer surface 112 and open to the environment (E) opposite the end portion 160.

As is illustrated, the surface component 150 along with the outer surface 112 of the exhaust component 108 define a holding reservoir, referred to herein as simply a reservoir 164. The reservoir 164 can have a reservoir inlet 161 and a reservoir outlet 162. The diverted flow (DF) can enter via the reservoir inlet 161, by way of non-limiting example through the opening 122. The diverted flow (DF) becomes held until the suction flow (SF) occurs drawing any fluids that may have passed through the opening 122 with the diverted flow (DF) back into the exhaust component 108. The reservoir must be at least large enough to hold the diverted flow (DF). Additionally, it must be sized to prevent fresh air from the environment (E) entering into the pipe with the suction flow (SF). Orienting the openings 122 such that the diverted flow (DF) passes in first in an aft direction with respect to the primary exhaust gas flow path (GFP), is beneficial in terms of holding the diverted flow (DF) until the suction flow (SF) occurs. In other words angling the openings 122 as described previously herein.

The reservoir 164 can have a reservoir volume (V). The volume can be split into two parts, an expansion volume ($V_E$) and a neck volume ($V_N$) such that the total reservoir volume (V) is the sum of these two parts.

$$V(\text{mm}^3)=V_E(\text{mm}^3)+V_N(\text{mm}^3) \qquad \text{Equation 1:}$$

The expansion volume ($V_E$) contains the diverted flow (DF) until the suction flow (SF) brings any fluids back into the exhaust component 108. The expansion volume ($V_E$) is the volume of the reservoir along the length of the first dimension 154.

The neck volume ($V_N$) is at least 20% of the reservoir volume (V). The neck volume ($V_N$) is the volume of the reservoir along the length of the second dimension 158. In other words, the neck volume ($V_N$) is the volume of the reservoir between the last set of openings 120 and the reservoir outlet 162. The neck volume ($V_N$) provides a boundary between the environment (E) and the expansion volume ($V_E$). In other words, the neck volume ($V_N$) prevents the diverted flow (DF) from exiting into the environment (E) and any fresh air entering from the environment (E).

A minimum reservoir volume ($V_{min}$) is required to enable any fluids that may have been drawn out with the diverted flow (DF) back into the exhaust component 108 via the suction flow (SF). Further the minimum reservoir volume ($V_{min}$) minimizes mixing of any fluids being held in the reservoir 164 with those in the environment (E). The minimum reservoir volume ($V_{min}$) is determined by a relationship between the initial mass flow traveling through the opening with the diverted flow (DF) in mass/unit of time and a cylinder count of the engine (N), an engine rotational specification (RPM), and a gas density (δ).

$$V_{min}(\mathrm{mm}^3) = DF\left(\frac{\mathrm{kg}}{\mathrm{hr}}\right)\left(\frac{1e9\ \mathrm{mm}^3/\mathrm{m}^3}{(N)(RPM)(60\ \mathrm{min/hr}\ \delta(\mathrm{kg/m}^3))}\right) \quad \text{Equation 2}$$

Figure 8:
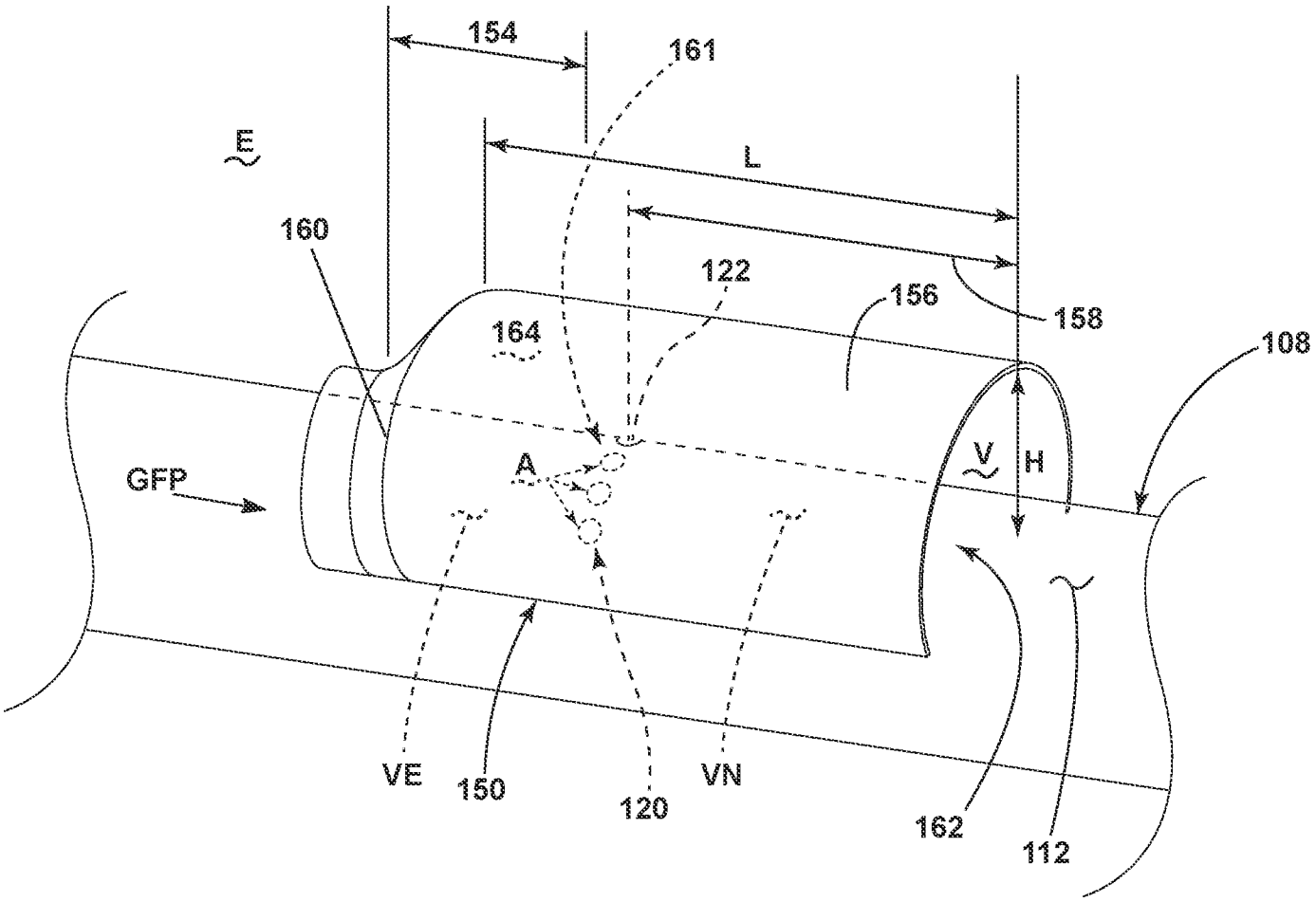
FIG. 8 is a perspective view of the surface component from FIG. 7 for the exhaust component of the vehicle exhaust system of FIG. 1, according to an aspect of the present disclosure.

Turning to FIG. 8, an isometric view of the surface component 150 on the exhaust component 108 is illustrated. Each opening 122 defines an area along the outer surface 112 such that the reservoir inlet 161 can collectively define an opening area (A) through which the diverted flow (DF) can pass. In order to enable any fluids drawn out along the diverted flow (DF) are drawn back into the exhaust component via the suction flow (SF), a ratio between the minimum reservoir volume ($V_{min}$) and the opening area (A) can be greater than 100 mm. It is also contemplated that the ratio ranges between 100 mm and 2000 mm.

$$100\ \mathrm{mm} \le \frac{V_{min}(\mathrm{mm}^3)}{A(\mathrm{mm}^2)} \le 2000\ \mathrm{mm} \quad \text{Equation 3}$$

Figure 9:
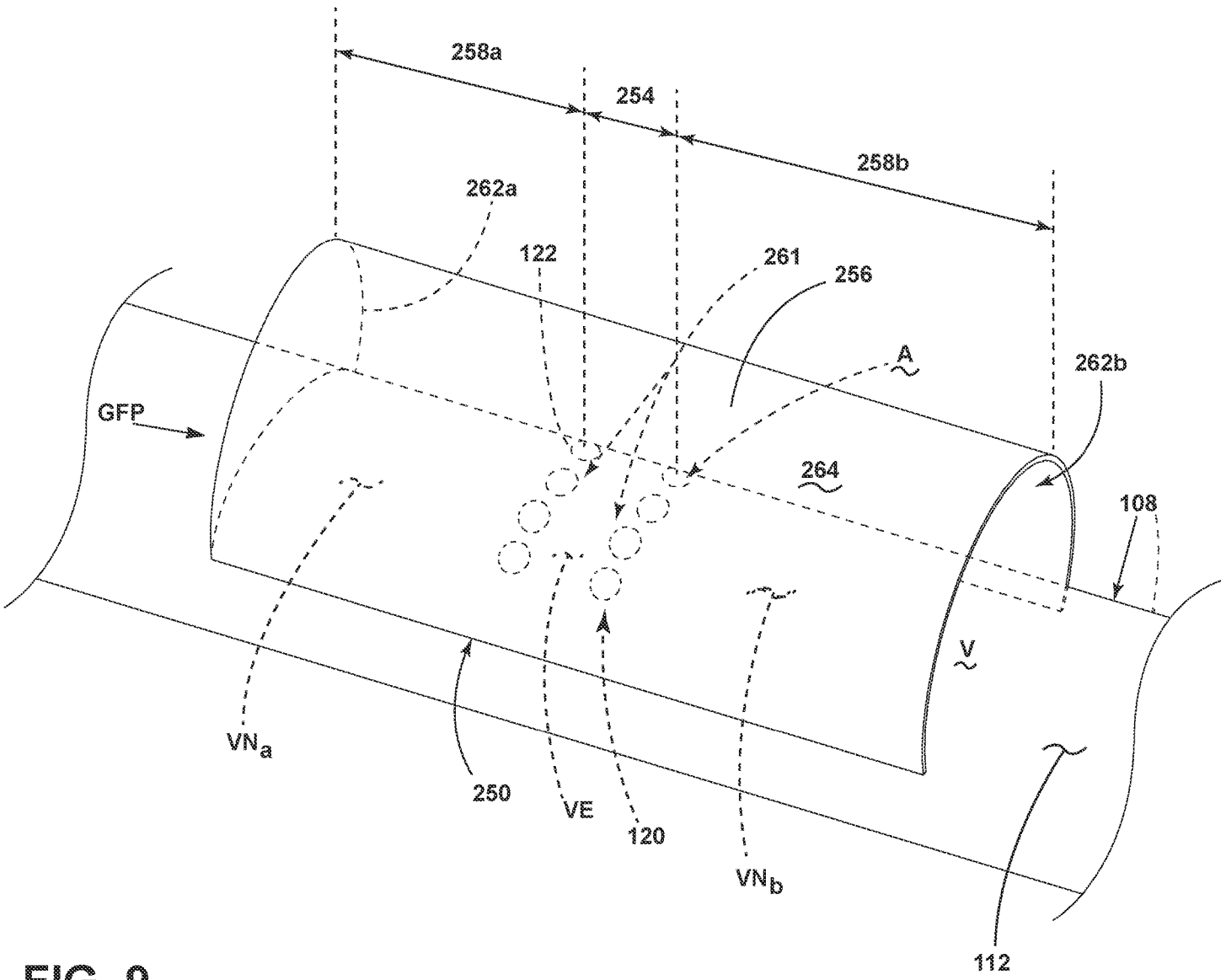
FIG. 9 is a perspective view of a variation of the surface component for the exhaust component of the vehicle exhaust system of FIG. 1, according to another aspect of the present disclosure.

FIG. 9 is an exemplary surface component 250 open on both ends to define two reservoir outlets 262*a*, 262*b*. A reservoir 264 defines a reservoir volume (V) equal to the minimum reservoir volume ($V_{min}$) as described herein. An expansion volume ($V_E$) is the volume of the reservoir along the length of a first dimension 254 between two sets of openings 120. A neck volume ($V_N$) is the volume of the reservoir 264 along the length of second and third dimensions 258*a*, 258*b*. In other words, the neck volume ($V_N$) is the volume of the reservoir 264 between the last set of openings 120 and the reservoir outlets 262*a*, 262*b*.

Figure 10:
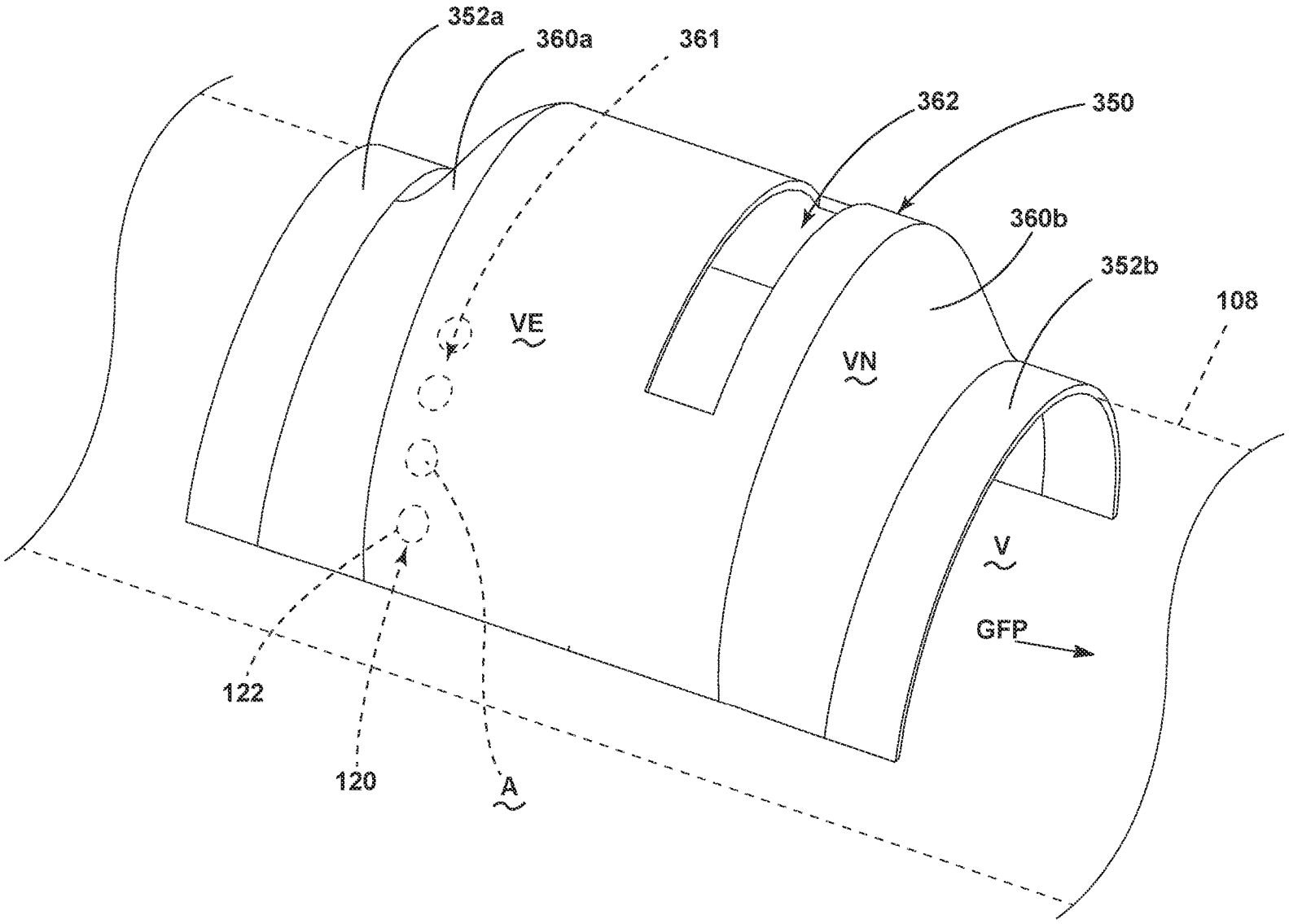
FIG. 10 is a perspective view of another variation of the surface component for the exhaust component of the vehicle exhaust system of FIG. 1, according to yet another aspect of the present disclosure.

FIG. 10 is an exemplary surface component 350 connected to the exhaust component 108 at a pair of flanges 352*a*, 352*b*. The surface component 350 can include a hood 356 spaced radially from the outer surface 112 of the exhaust component 108 as previously described herein. Unlike the previous embodiments, the surface component 350 includes a reservoir outlet 362 in the hood 356. By way of non-limiting example the reservoir outlet 362 can align with the set of openings 120 as illustrated. In this manner the surface component 350 is closed on opposing end portions 360*a*, 360*b* extending between the hood 356 and corresponding flanges 352*a*, 352*b*. A reservoir 364 defines a reservoir volume (V) equal to the minimum reservoir volume ($V_{min}$) as described herein. A ratio between the minimum reservoir volume ($V_{min}$) and the opening area (A) ranges between 100 and 2000. An expansion volume ($V_E$) is the volume of the reservoir 364 proximate the end portion 360*a* and the reservoir inlet 361. A neck volume ($V_N$) is the volume of the reservoir 364 proximate the end portion 360*b* and the reservoir outlet 362. In other words, the neck volume ($V_N$) is the volume of the reservoir 364 between the last set of openings 120 and the reservoir outlet 362.

Figure 11A:
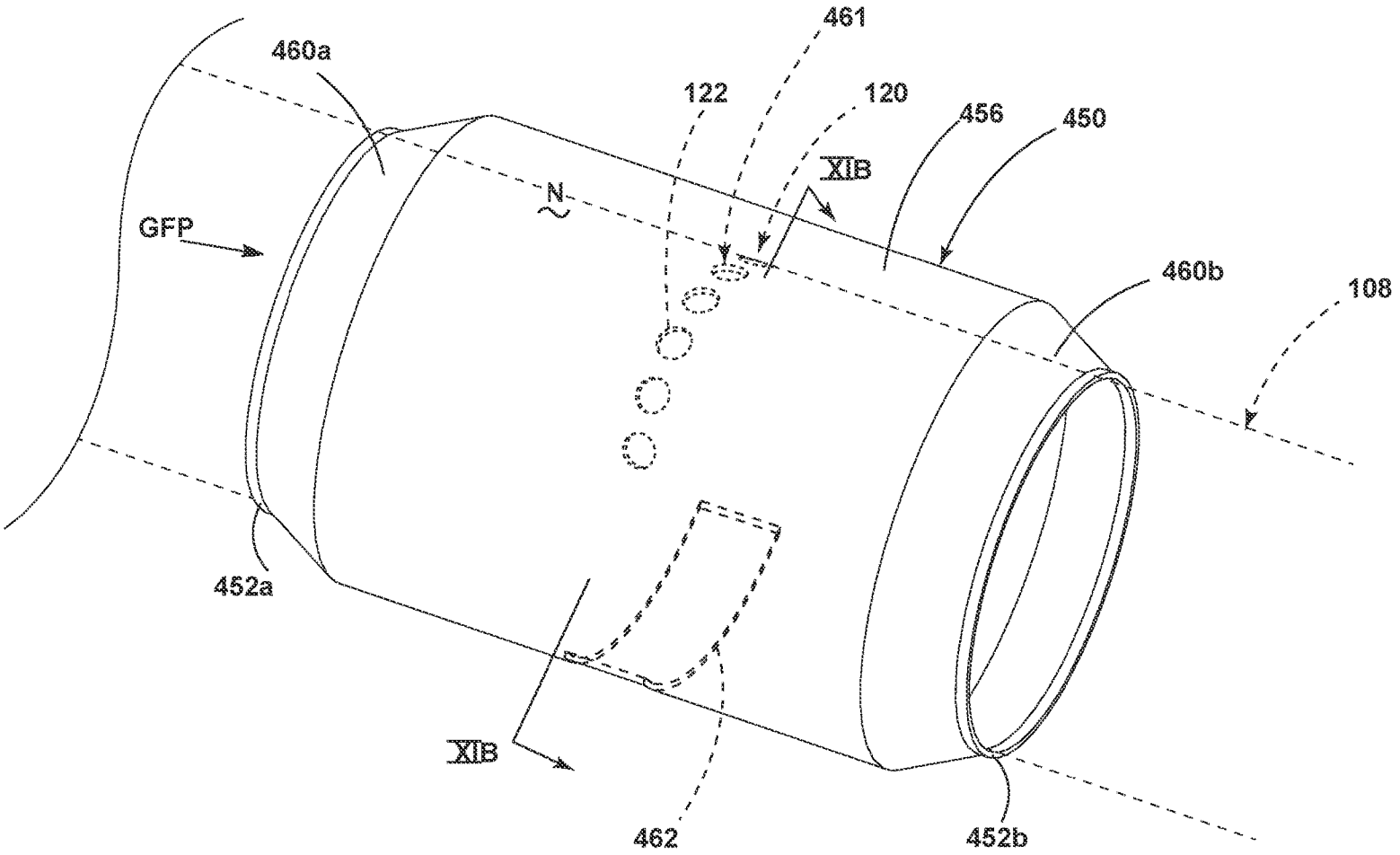
FIG. 11A is a perspective view of yet another variation of the surface component for the exhaust component of the vehicle exhaust system of FIG. 1, according to another aspect of the present disclosure.

FIG. 11 is yet another exemplary surface component 450 according to another aspect of the disclosure herein. The surface component 450 can encase exhaust component 108 leaving a ring-shaped reservoir volume (V) between the surface component and the outer surface 112 of the exhaust component 108. A pair of flanges 452*a*, 452*b* can surround the outer surface 112 enclosing the exhaust component 108. The surface component 450 can include a hood 456 spaced radially from the outer surface 112 of the exhaust component 108 as previously described herein. Like surface component 350, surface component 450 can include a reservoir outlet 462 in the hood 456. Unlike surface component 450, the reservoir outlet 462 can be located on an opposite side of the exhaust component 108 with respect to the set of openings 120 as illustrated. In this manner the surface component 450 is closed on opposing end portions 460*a*, 460*b* extending between the hood 456 and corresponding flanges 452*a*, 452*b*. A reservoir 464 defines a reservoir volume (V) equal to the minimum reservoir volume ($V_{min}$) as described herein. A ratio between the minimum reservoir volume ($V_{min}$) and the opening area (A) ranges between 100 and 2000.

Figure 11B:
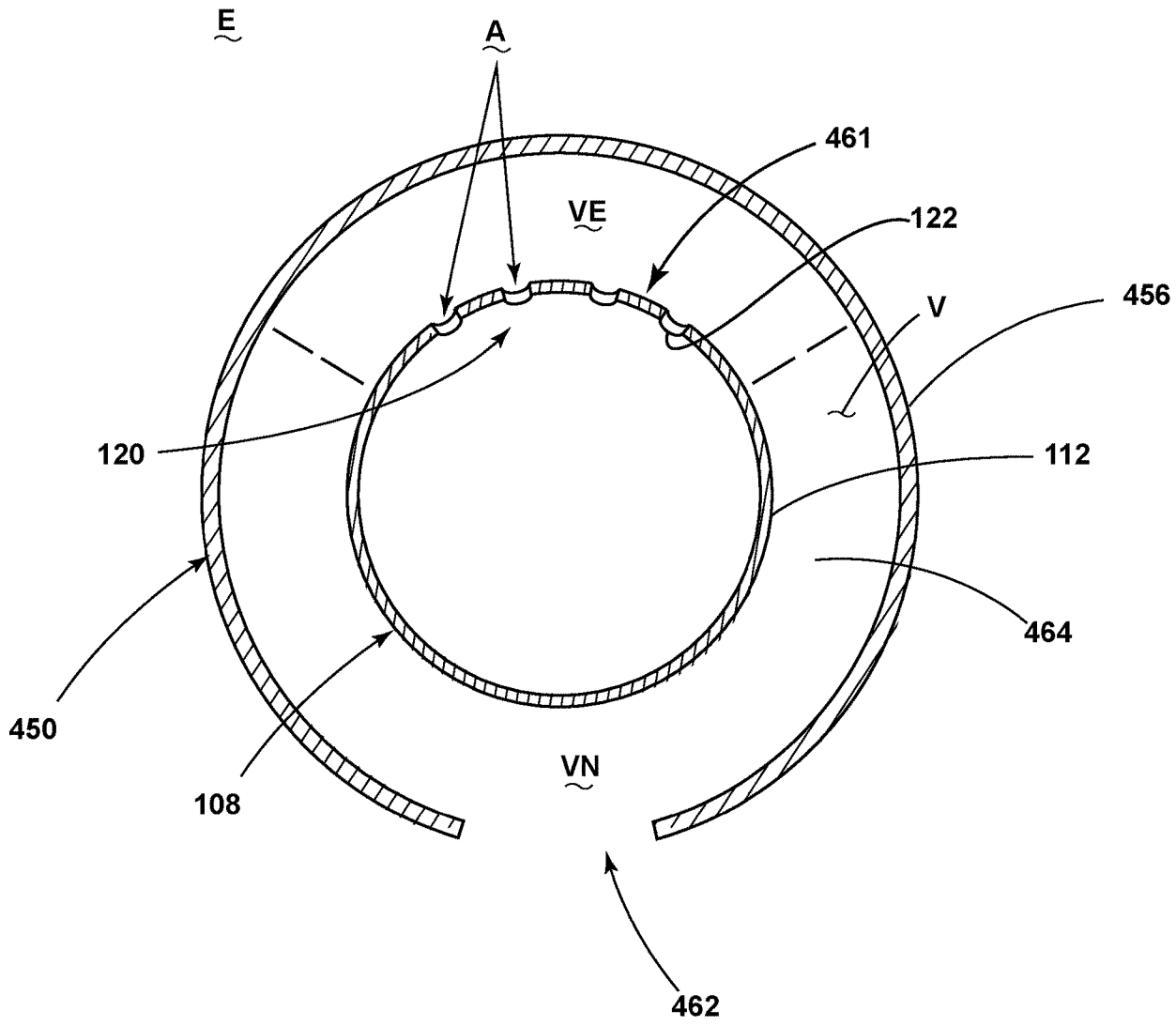
FIG. 11B is a cross-sectional view of the surface component of FIG. 11.

FIG. 11B is a cross-section of surface component 450 and exhaust component 108. An expansion volume ($V_E$) is the volume of the reservoir 464 between the hood 456 and the exhaust component 108 surrounding the reservoir inlet 461. A neck volume ($V_N$) is the volume of the reservoir 464 between the hood 456 and the exhaust component 108 surrounding the reservoir outlet 462. In other words, the neck volume ($V_N$) is the volume of the reservoir 464 between the last opening 122 on either end of the set of openings 120 and the reservoir outlet 462, separated from the expansion volume ($V_E$) by dashed lines.

Figure 12:
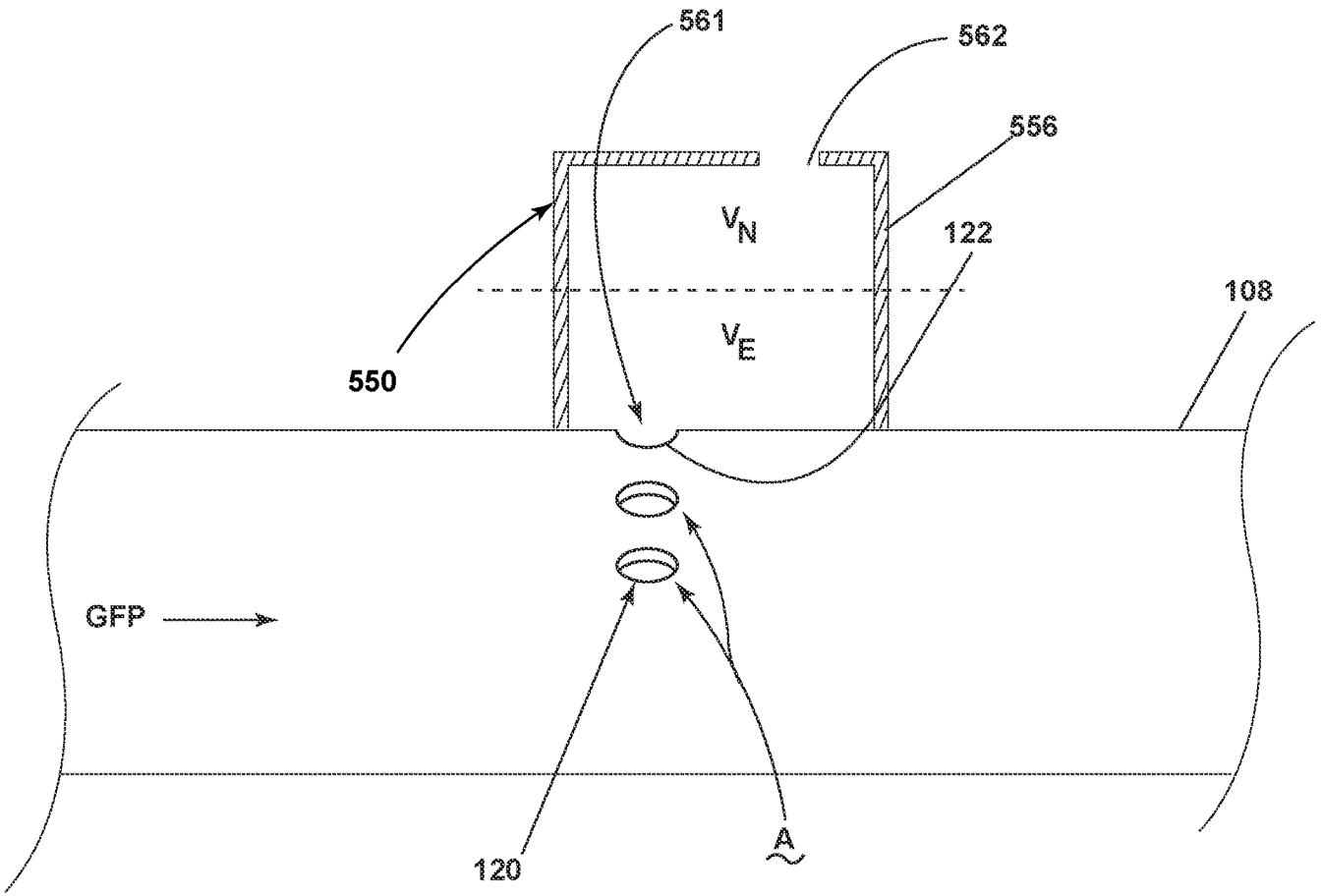
FIG. 12 is a schematic representation of still another variation of the surface component for the exhaust component of the vehicle exhaust system of FIG. 1, according to another aspect of the present disclosure.

FIG. 12 is a schematic drawing of yet another exemplary surface component 550 according to another aspect of the disclosure herein. The surface component 550 can be formed as a "chimney" extending directly from the outer surface 112 of the exhaust component 108 and terminating in a reservoir outlet 562 located in a hood 556. While illustrated as a "chimney" with the reservoir outlet 562 located directly opposite the set of openings 120, it should be understood that the reservoir outlet 562 can be located on any portion of the surface component 550 including sides 553. A reservoir 564 defines a reservoir volume (V) equal to the minimum reservoir volume ($V_{min}$) as described herein. A ratio between the minimum reservoir volume ($V_{min}$) and the opening area (A) ranges between 100 and 2000. An expansion volume ($V_E$) is the volume of the reservoir 564 surrounding the reservoir inlet 561. A neck volume ($V_N$) is the volume of the reservoir 464 between the hood 556 and expansion volume ($V_E$) surrounding the reservoir outlet 562 illustrated in dashed lines.

Figure 13A:
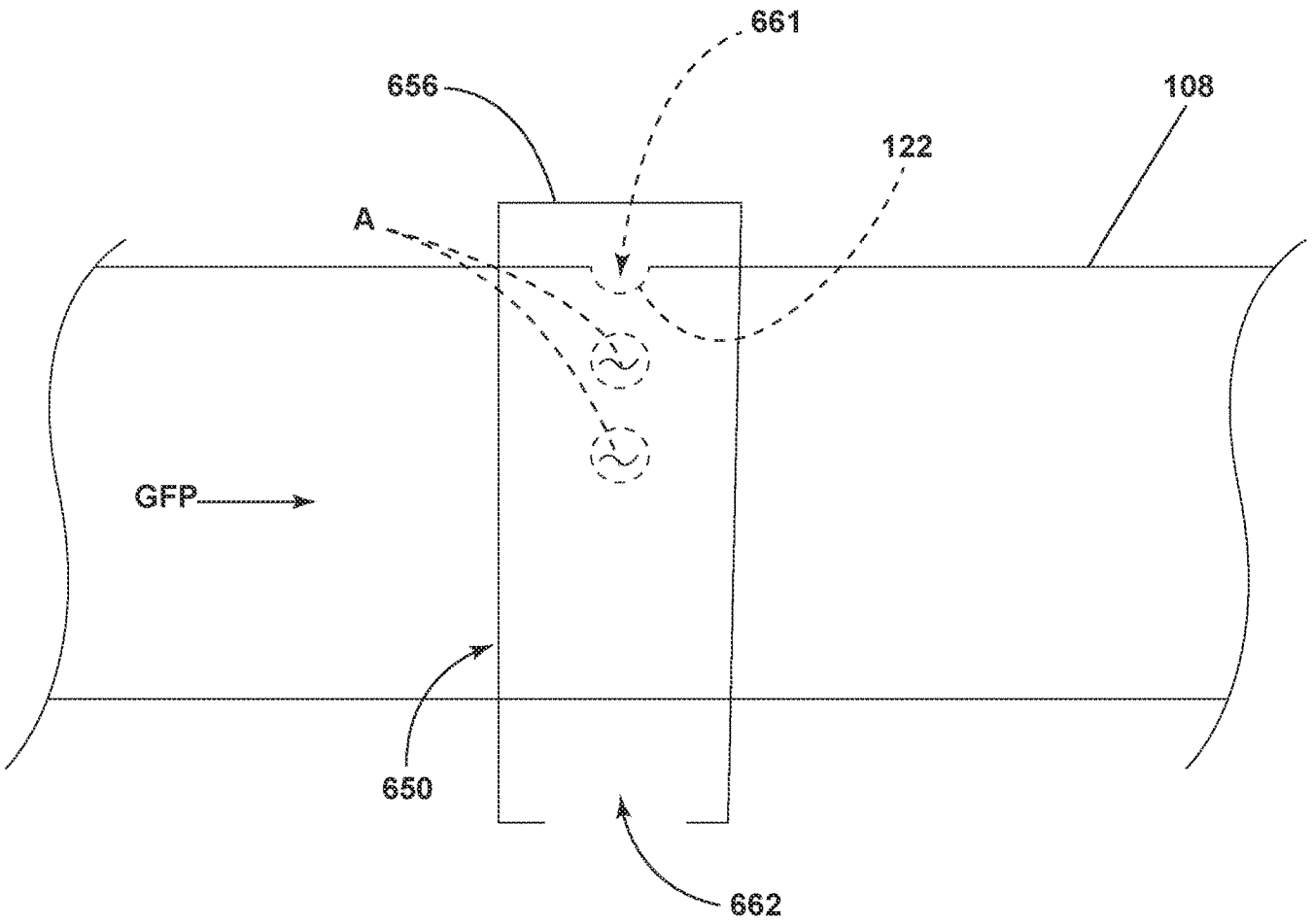
FIG. 13A is a schematic representation another variation of the surface component for the exhaust component of the vehicle exhaust system of FIG. 1, according to another aspect of the present disclosure.

FIG. 13 is a schematic drawing of yet another exemplary surface component 650 according to another aspect of the disclosure herein. The surface component 650 can be formed as a "reverse chimney" extending directly from the outer surface 112 of the exhaust component 108. The reverse aspect of the chimney surface component 650 is that it terminates in a reservoir outlet 662 located on an opposite side of the exhaust component 108 with respect to the set of openings 120 as illustrated. A reservoir 664 defines a reservoir volume (V) equal to the minimum reservoir volume (Vmin) as described herein. A ratio between the minimum reservoir volume (Vmin) and the opening area (A) ranges between 100 and 2000.

Figure 13B:
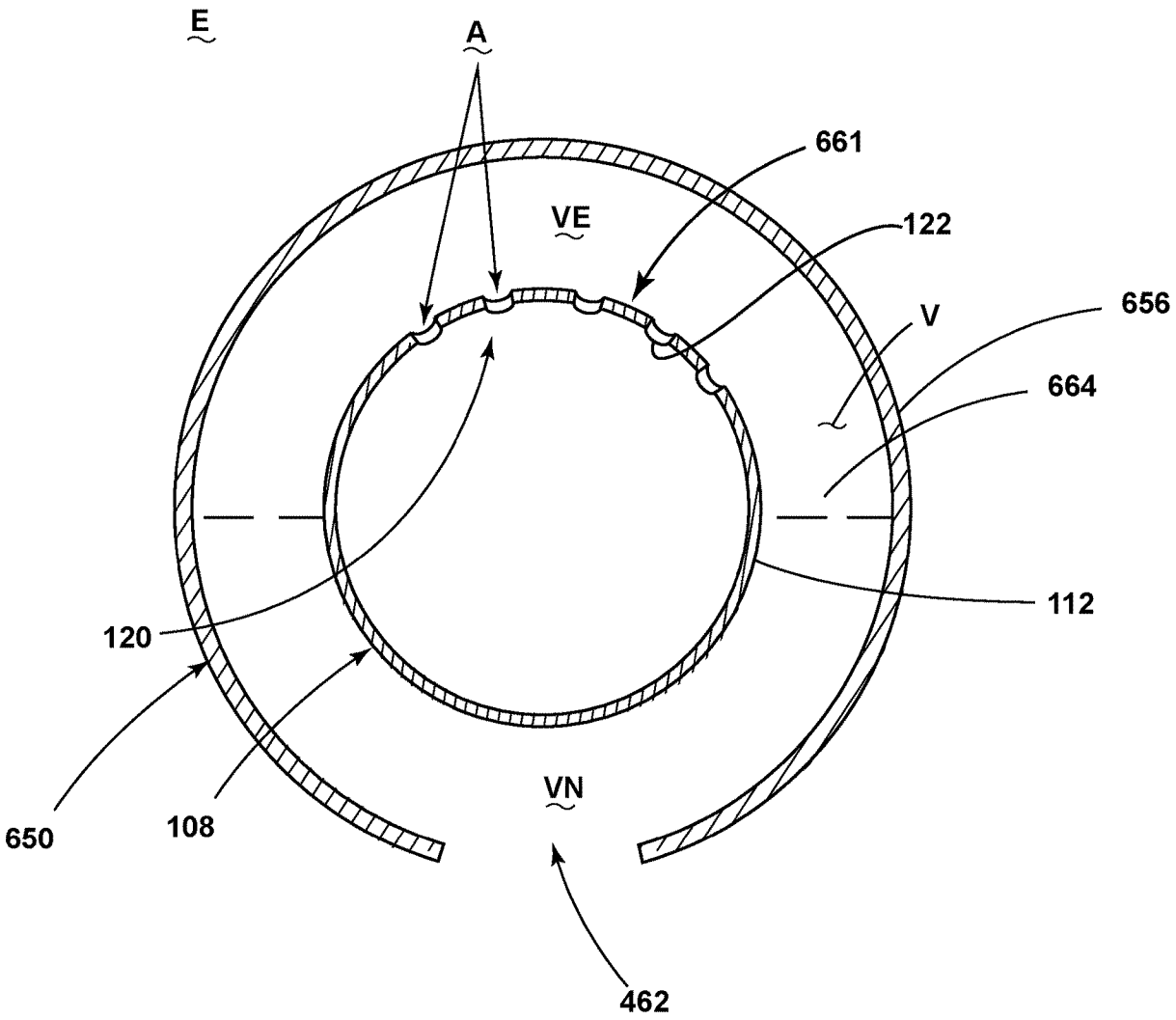
FIG. 13B is a cross-sectional view of the surface component of FIG. 11.

FIG. 13B is a cross-section of surface component 650 and exhaust component 108. An expansion volume ($V_E$) is the volume of the reservoir 664 between the hood 656 and the exhaust component 108 surrounding the reservoir inlet 661. A neck volume ($V_N$) is the volume of the reservoir 664 between the hood 656 and the exhaust component 108 surrounding the reservoir outlet 462. In other words, the neck volume ($V_N$) is approximately half of the volume of the reservoir while the expansion volume ($V_E$) is the other half, separated from each other by dashed lines.

Figure 14:
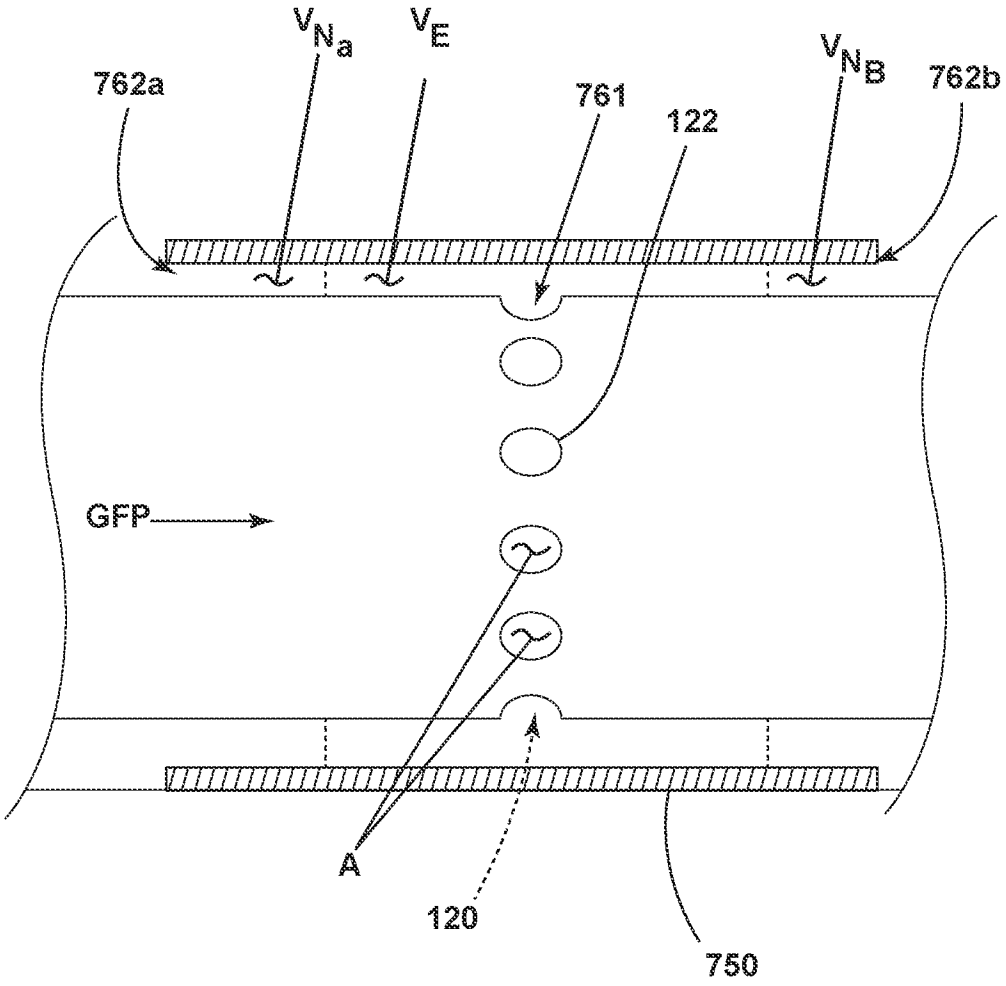
FIG. 14 is a schematic representation another variation of the surface component for the exhaust component of the vehicle exhaust system of FIG. 1, according to another aspect of the present disclosure.

FIG. 14 is a schematic drawing of yet another exemplary surface component 750 according to another aspect of the disclosure herein. The surface component 750 is open on both ends to define two reservoir outlets 762*a*, 762*b*. Each reservoir outlet 762*a*, 762*b* defines a ring-shaped outlet area. A reservoir 764 defines a reservoir volume (V) can be equal to the minimum reservoir volume (Vmin) as described herein. A ratio between the minimum reservoir volume (Vmin) and the opening area (A) ranges between 100 and 2000.

Figure 15:
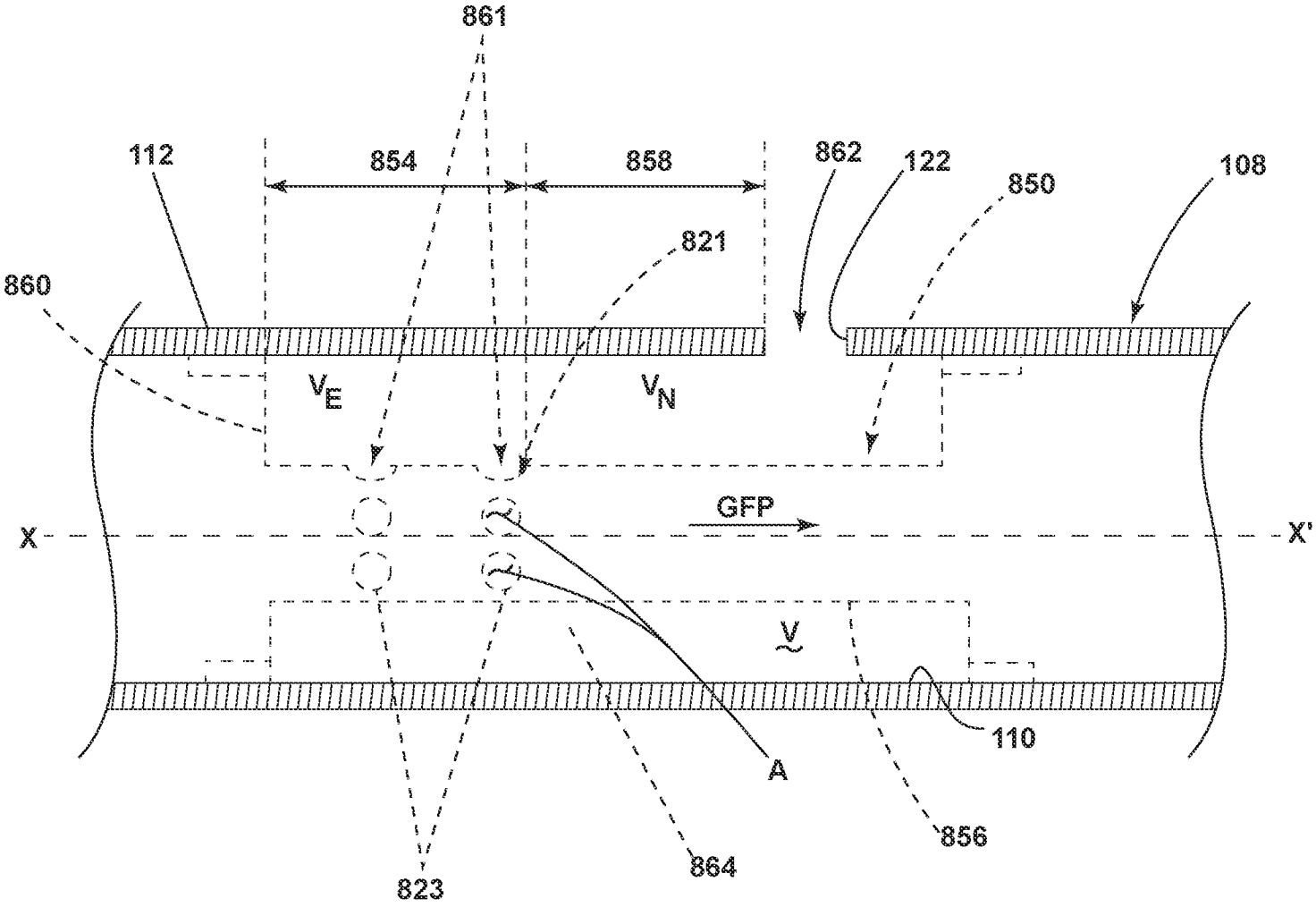
FIG. 15 is a schematic representation another variation of the surface component for the exhaust component of the vehicle exhaust system of FIG. 1, according to another aspect of the present disclosure.

FIG. 15 is a schematic drawing of yet another exemplary surface component 850 according to another aspect of the disclosure herein. The surface component 850 can be formed as an insert. A hood 856 of the surface component 850 can be radially spaced from the inner surface 110 of the exhaust component 108 to define a reservoir 864. At least one opening 823 can be formed in the hood 856 and define a reservoir inlet 861 having an opening area (A) as described herein. The opening 122 can define a reservoir outlet 862. The reservoir 864 defines a reservoir volume (V) equal to the minimum reservoir volume (Vmin) as described herein. A ratio between the minimum reservoir volume (Vmin) and the opening area (A) ranges between 100 and 2000.

An expansion volume ($V_E$) is the volume of the reservoir along the length of a first dimension 854 measured from a set of openings 821 nearest the reservoir outlet 862 to an end 860 of the surface component 850. A neck volume ($V_N$) is the volume of the reservoir 864 along the length of a second dimension 858 measured from the set of openings 821 to the reservoir outlet 862. In other words, the neck volume ($V_N$) is the volume of the reservoir 864 between the last set of openings 821 area proximate the reservoir outlet 862.

Figure 16:
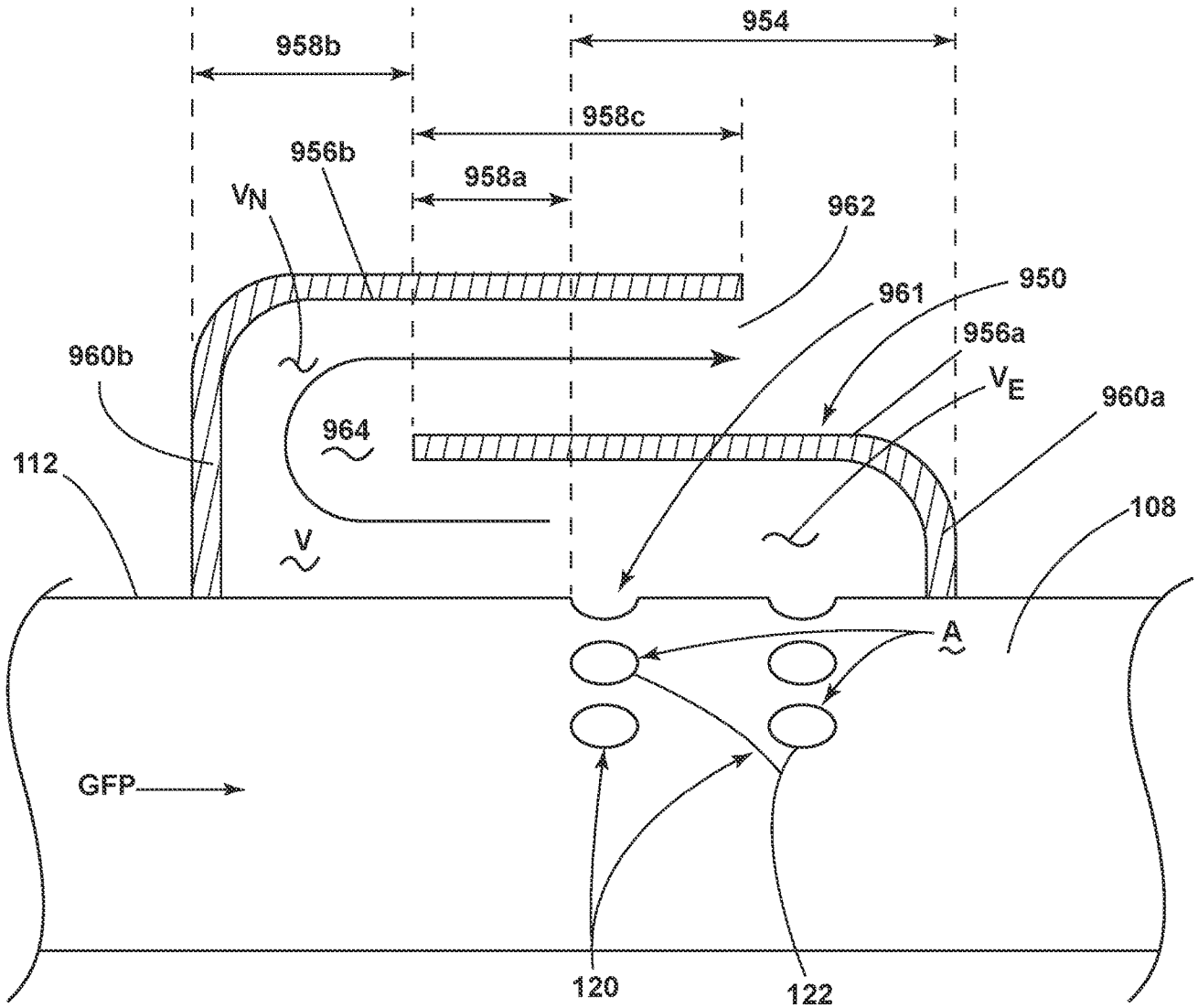
FIG. 16 is a schematic representation another variation of the surface component for the exhaust component of the vehicle exhaust system of FIG. 1, according to another aspect of the present disclosure.

FIG. 16 is a schematic drawing of yet another exemplary surface component 950 according to another aspect of the disclosure herein. The surface component 950 can be formed with a double hood 956 comprising a first hood 956*a* and a second hood 956*b* radially spaced from the first hood 956*a*. As is illustrated, the surface component 950 along with the outer surface 112 of the exhaust component 108 define a holding reservoir 964. The first hood 956*a* can be connected to the exhaust component 108 at a first end 960*a* upstream from the set of openings 120. The first hood 956*a* can extend parallel to the outer surface 112 and downstream from the first end 960*a* a first dimension 954 to a last set of the set of openings 120. The first hood 956*a* can further extend a second dimension 958*a* from the last set of the set of openings 120. While illustrated as two separate hoods 956*a*, 956*b*, it is contemplated that the first and second hoods 956*a*, 956*b* are part of a single unit defining the surface component 950. The unit can be modular or monolithic. In other words the first and second hoods 956*a*, 956*b* can be coupled to each other in a known fabrication.

The second hood 956*b* can be connected to the exhaust component 108 at a second end 960*b* spaced a third dimension 958*b* downstream from the first hood 956*a*. The second hood 956*b* can extend parallel to the first hood 956*a* toward the first end 960*a*. The second hood 956*b* overlaps with the first hood 956*a* a fourth dimension 958*c*. The second hood 956*b* is radially spaced from the first hood 956*a* to define a reservoir outlet 962.

The reservoir 964 can have a reservoir inlet 961 defined by the set of openings 120. The reservoir 964 defines a reservoir volume (V) equal to the minimum reservoir volume (Vmin) as described herein. A ratio between the minimum reservoir volume (Vmin) and the opening area (A) ranges between 100 and 2000.

An expansion volume ($V_E$) is the volume of the reservoir along the length of the first dimension 954 measured from the last of the set of openings 120 (nearest the reservoir outlet 962) to the first end 960*a* of the surface component 950. A neck volume ($V_N$) is the volume of the reservoir 964 along the length defined by the sum of the second, third, and fourth dimensions 958*a*, 958*b*, 958*c* measured from the last of the set of openings 120 to the reservoir outlet 962. In other words, the neck volume ($V_N$) is the volume of the reservoir 964 between the reservoir inlet 961 and the reservoir outlet 962.

FIGS. 7-16 are illustrations of exemplary surface components 150, 250, 350, 450, 550, 650, 750, 850, 950. It should be understood that aspects of each can be combined to form any type of pulsation surface component for use in the system 100 as described herein.

Figure 17:
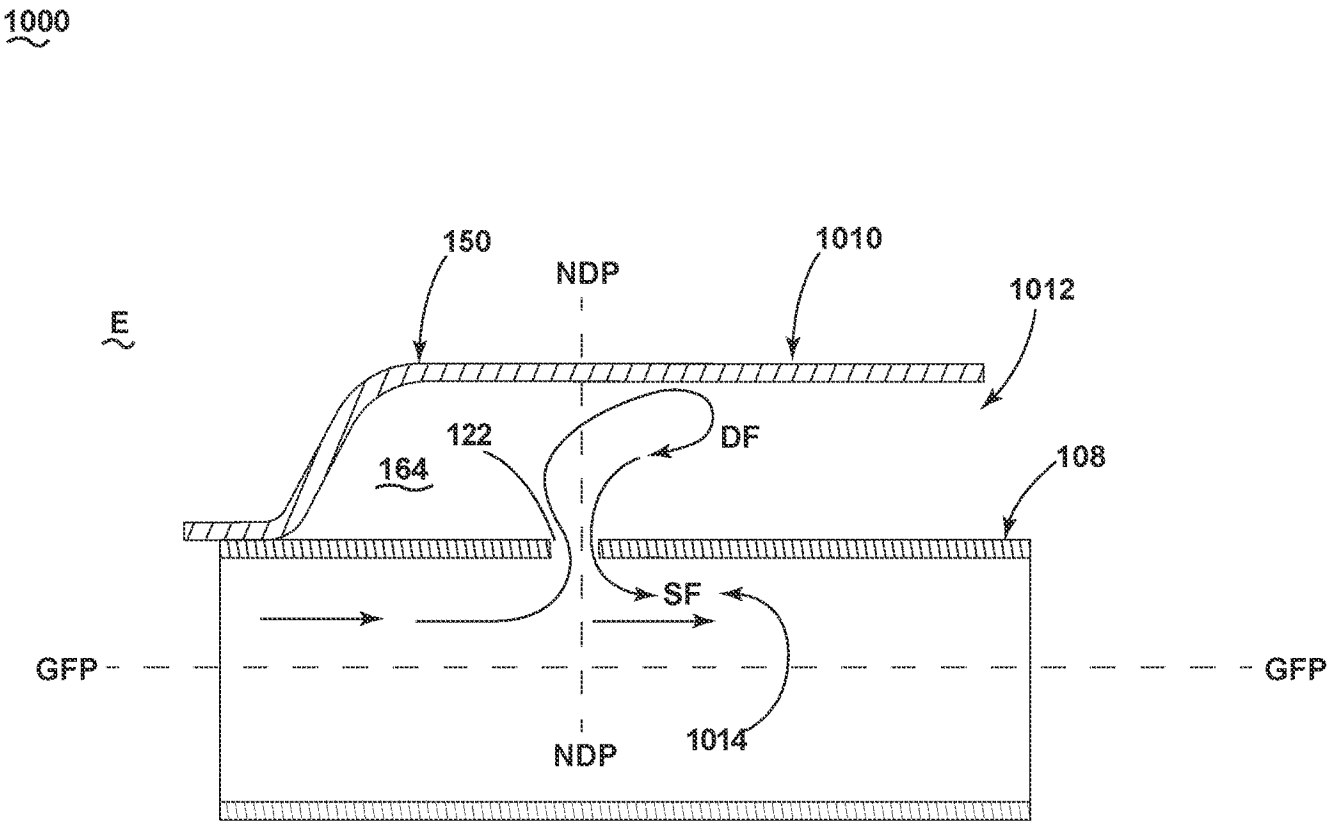
FIG. 17 is the same as FIG. 7 illustrating a method according to an aspect of the present disclosure.

A method 1000 of minimizing the leaked mass flow (LF) is illustrated in FIG. 17 utilizing a copy of FIG. 7 with some numbers removed for clarity. The method includes at 1010 covering the at least one opening 122 with the surface component 150 to define the reservoir 164. Holding at 1012 the initial mass flow of fluid having left the exhaust component 108 with the diverted flow (DF) in the reservoir. A time associated with holding depends on the (RPM), engine cycle, idling, and other factors described herein that affect positive (+) and negative (−) mass flow along the noise damper path (NDP). The method 1000 further includes at 1014 drawing at least a portion of the initial mass flow back into the vehicle exhaust component with the suction flow (SF) as described herein. The method can further include holding the initial mass flow in the reservoir with the minimum reservoir volume directly related to an amount of the initial mass flow. Minimizing pressure differentiations between the primary exhaust gas flow path (GFP), the reservoir 164, and the environment (E) can be accomplished by fluidly coupling the reservoir to the exterior environment (E) with the reservoir outlet 162 as described herein. While described in relationship with surface component 150, it should be understood the method 1000 can be applied utilizing covers 150, 250, 350, 450, 550, 650, 750, 850, 950.

Engine mass flow in an exhaust system can go in both positive and negative directions as described herein as a diverted flow (positive) and a suction flow (negative). With the openings located in the exhaust member as described herein the positive and negative mass flow can cause flow through the openings in both directions—positive, leaking gases outside and negative, drawing outside air into the exhaust. This occurs primarily on low frequency pulsating flow, most prevalent on engines having 1-6 explosions per one engine cycle. Other low frequency situations include idle, close to idle engine run conditions (low RPM's), or run down conditions. Additionally, any leaking that occurs during an engine cold start can also be contained. Leaking gasses, including CO and $CO_2$ prior to the end, or primary outlet, of an exhaust system is undesirable. Therefore, holding the leaked gasses in a predetermined volume defined by the reservoirs formed by the surface components described herein is beneficial. Utilizing the positive and negative mass flow to suck the leaked gasses back into the primary exhaust gas flow path without mixing with air from the environment ensures fair and accurate emission testing.

To the extent not already described, the different features and structures of the various aspects can be used in combination, or in substitution with each other as desired. That one feature is not illustrated in all of the examples is not meant to be construed that it cannot be so illustrated, but is done for brevity of description. Thus, the various features of the different aspects can be mixed and matched as desired to form new aspects, whether or not the new aspects are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

While aspects of the present disclosure have been particularly shown and described with reference to the embodiments above, it will be understood by those skilled in the art that various additional embodiments can be contemplated by the modification of the disclosed machines, systems and methods without departing from the spirit and scope of what is disclosed. Such embodiments should be understood to fall within the scope of the present disclosure as determined based upon the claims and any equivalents thereof.

Further aspects of the disclosure are provided by the subject matter of the following clauses:

A vehicle exhaust system comprising an exhaust component defining a central axis and having an inner surface and an outer surface, such that the inner surface defines a primary exhaust gas flow path extending along the central axis from an inlet to an outlet, and a surface component having a hood spaced from the exhaust component to define a reservoir having a reservoir volume (V), the reservoir comprising a reservoir inlet fluidly coupled to the primary exhaust gas flow path and defining an inlet area (A), and a reservoir outlet fluidly coupled to an outside environment; wherein a minimum reservoir volume (Vmin) to inlet area $$100\ \text{mm}: \left(100\ \text{mm} \leq \frac{V_{min}(\text{mm}^3)}{A(\text{mm}^2)}\right).$$

The vehicle exhaust system of any preceding clause, wherein the surface component is attached to the outer surface of the exhaust component and the reservoir inlet is a set of openings extending through the inner surface to the outer surface of the exhaust component.

The vehicle exhaust system of any preceding clause, wherein the hood is spaced radially from the outer surface of the exhaust component such that the hood and the outer surface together define the reservoir.

The vehicle exhaust system of any preceding clause, wherein the surface component is connected to the exhaust component at a first flange spaced upstream of the set of openings a first dimension.

The vehicle exhaust system of any preceding clause, wherein the hood extends parallel to the outer surface from the first flange downstream of the set of openings a second dimension.

The vehicle exhaust system of any preceding clause, wherein an end portion extends between the flange and hood to define a closed end of the surface component.

The vehicle exhaust system of any preceding clause, wherein the surface component is connected to the exhaust component at a second flange spaced downstream of the set of openings and wherein a first and second end portion each extend between the first and second flanges respectively and the hood to define closed ends of the surface component.

The vehicle exhaust system of any preceding clause, wherein the reservoir outlet is located in the hood.

The vehicle exhaust system of any preceding clause, wherein the reservoir outlet aligns with the set of openings.

The vehicle exhaust system of any preceding clause, wherein the first and second flanges surround the outer surface enclosing the exhaust component and the reservoir outlet is located on a side of the hood opposite the set of openings.

The vehicle exhaust system of any preceding clause, wherein the reservoir outlet is two reservoir outlets defining either ends of the reservoir and wherein the hood extends parallel to the outer surface and terminates at the two reservoir outlets.

The vehicle exhaust system of any preceding clause, wherein the two reservoir outlets each form a ring shape-shaped outlet area.

The vehicle exhaust system of any preceding clause, wherein the surface component is formed as a chimney around the set of openings.

The vehicle exhaust system of any preceding clause, wherein the surface component is attached to the inner surface of the exhaust component and the reservoir inlet is a set of openings extending through the hood of the surface component.

The vehicle exhaust system of any preceding clause, wherein the hood is spaced radially from the inner surface of the exhaust component such that the hood and the inner surface together define the reservoir.

The vehicle exhaust system of any preceding clause, wherein the reservoir outlet is a set of openings extending through the inner surface to the outer surface of the exhaust component.

The vehicle exhaust system of any preceding clause, wherein fluid traveling along the primary exhaust gas flow path and through the reservoir inlet defines a diverted flow (DF).

The vehicle exhaust system of any preceding clause, wherein a minimum volume of the reservoir ($V_{min}$) is determined by a relationship between the amount of diverted flow (DF) in mass/unit of time and a cylinder count of the engine (N), an engine rotational specification (RPM), and a gas density (δ).

A surface component for a vehicle exhaust component comprising at least one opening and a hood to define a reservoir defining a volume (V) fluidly coupled to an outside environment via the at least one opening, wherein a minimum reservoir volume ($V_{min}$) is related to a diverted flow (DF) received in the reservoir by the following equation:

$$V_{min}(\mathrm{mm}^3) = DF\left(\frac{\mathrm{kg}}{\mathrm{hr}}\right)\left(\frac{1e9\ \mathrm{mm}^3/\mathrm{m}^3}{(N)(RPM)(60\ \mathrm{min/hr}\ \delta(\mathrm{kg}/\mathrm{m}^3))}\right)$$

where (N) is a cylinder count of the engine (N), (RPM) stands for revolutions per minutes and is an engine rotational specification, and (δ) is a gas density of gas in the diverted flow (DF).

A vehicle exhaust system comprising the surface component of any preceding clause, the vehicle exhaust system defining a central axis and having an inner surface and an outer surface, such that the inner surface defines a primary exhaust gas flow path extending along the central axis from an inlet to an outlet, and the hood spaced from the exhaust component to define the volume (V), the reservoir comprising a reservoir inlet fluidly coupled to the primary exhaust gas flow path and defining an inlet area (A), and a reservoir outlet fluidly coupled to an outside environment; wherein a minimum reservoir volume (Vmin) to inlet area (A) ratio is greater than or equal to 100 mm:(100 mm≤$V_{min}$(mm$^3$)/A (mm$^2$)).

The vehicle exhaust system of any preceding clause, wherein the volume (V) comprises two parts, an expansion volume and a neck volume.

The vehicle exhaust system of any preceding clause, wherein the expansion volume contains the diverted flow (DF) until the suction flow (SF) brings any fluids back into the exhaust component.

The vehicle exhaust system of any preceding clause, wherein the neck volume is at least 20% of the reservoir volume (V).

The vehicle exhaust system of any preceding clause, wherein the neck volume is the volume of the reservoir between the reservoir inlet and the reservoir outlet.

The vehicle exhaust system of any preceding clause, wherein the neck volume provides a boundary between the environment and the expansion volume.

The vehicle exhaust system of any preceding clause, wherein the neck volume prevents the diverted flow (DF) from exiting into the environment and any fresh air entering from the environment.

A method of minimizing a leaked mass flow for a vehicle exhaust component, the method comprising covering an opening extending through a surface of the vehicle exhaust component with a surface component to define a reservoir having a reservoir inlet and a reservoir outlet, the reservoir having a reservoir volume (V); holding a diverted flow (DF) in the reservoir; drawing at least a portion of the diverted flow (DF) through a reservoir inlet into the vehicle exhaust component; and determining a minimum reservoir volume ($V_{min}$) by the following equation:

$$V_{min}(\mathrm{mm}^3) = DF\left(\frac{\mathrm{kg}}{\mathrm{hr}}\right)\left(\frac{1e9\ \mathrm{mm}^3/\mathrm{m}^3}{(N)(RPM)(60\ \mathrm{min/hr}\ \delta(\mathrm{kg}/\mathrm{m}^3))}\right)$$

where (N) is a cylinder count of the engine (N), (RPM) stands for revolutions per minute and is an engine rotational specification, and (δ) is a gas density of gas in the diverted flow (DF).

The method of any preceding clause wherein holding the diverted flow (DF) is associated with a time that depends on the RPM.

The method of any preceding clause further comprising drawing at least a portion of the diverted flow (DF) back into the vehicle exhaust component with the suction flow (SF).

What is claimed is:

1. A vehicle exhaust system comprising:

an exhaust component defining a central axis and having an inner surface and an outer surface, such that the inner surface defines a primary exhaust gas flow path extending along the central axis from an inlet to an outlet; and a surface component having a hood spaced from the exhaust component to define a reservoir having a reservoir volume (V), the reservoir comprising a reservoir inlet fluidly coupled to the primary exhaust gas flow path and defining an inlet area (A), and a reservoir outlet fluidly coupled to an outside environment;

wherein fluid traveling along the primary exhaust gas flow path and through the reservoir inlet defines a diverted flow (DF) and the hood holds the diverted flow (DF) within the reservoir;

wherein the hood enables the diverted flow (DF) to change direction at least once within the reservoir; wherein the diverted flow (DF) flows through the reservoir in a first direction and a second direction opposite the first direction; and wherein a minimum reservoir volume (Vmin) to inlet area (A) ratio is greater than or equal to $$100\ \underline{\mathrm{mm}}:\left(100\ \mathrm{mm} \le \frac{V_{min}(\mathrm{mm}^3)}{A(\mathrm{mm}^2)}\right).$$

2. The vehicle exhaust system of claim 1, wherein the surface component is attached to the outer surface of the exhaust component and the reservoir inlet is a set of openings extending through the inner surface to the outer surface of the exhaust component.

3. The vehicle exhaust system of claim 2, wherein the hood is spaced radially from the outer surface of the exhaust component such that the hood and the outer surface together define the reservoir.

4. The vehicle exhaust system of claim 3, wherein the surface component is connected to the exhaust component at a first flange spaced upstream of the set of openings a first dimension.

5. The vehicle exhaust system of claim 4, wherein the hood extends parallel to the outer surface from the first flange downstream of the set of openings a second dimension.

6. The vehicle exhaust system of claim 5, wherein an end portion extends between the first flange and hood to define a closed end of the surface component.

7. The vehicle exhaust system of claim 5, wherein the reservoir outlet is a set of openings extending through the inner surface to the outer surface of the exhaust component.

8. The vehicle exhaust system of claim 4, wherein the surface component is connected to the exhaust component at a second flange spaced downstream of the set of openings and wherein a first and second end portion each extend between the first and second flanges respectively and the hood to define closed ends of the surface component.

9. The vehicle exhaust system of claim 8, wherein the reservoir outlet is located in the hood.

10. The vehicle exhaust system of claim 9, wherein the reservoir outlet aligns with the set of openings.

11. The vehicle exhaust system of claim 9, wherein the first and second flanges surround the outer surface enclosing the exhaust component and the reservoir outlet is located on a side of the hood opposite the set of openings.

12. The vehicle exhaust system of claim 4, wherein the hood is spaced radially from the inner surface of the exhaust component such that the hood and the inner surface together define the reservoir.

13. The vehicle exhaust system of claim 2, wherein the reservoir outlet is two reservoir outlets defining either ends of the reservoir and wherein the hood extends parallel to the outer surface and terminates at the two reservoir outlets.

14. The vehicle exhaust system of claim 13, wherein the two reservoir outlets each form a ring shape-shaped outlet area.

15. The vehicle exhaust system of claim 2, wherein the surface component is formed as a chimney around the set of openings.

16. The vehicle exhaust system of claim 1, wherein the surface component is attached to the inner surface of the exhaust component and the reservoir inlet is a set of openings extending through the hood of the surface component.

17. The vehicle exhaust system of claim 1, wherein a minimum volume of the reservoir ($V_{min}$) is determined by a relationship between an amount of the diverted flow (DF) in mass/unit of time and a cylinder count of an engine (N), an engine rotational specification (RPM), and a gas density (δ).

18. The vehicle exhaust system of claim 1 wherein the diverted flow (DF) flows through the reservoir in a direction parallel to the primary exhaust gas flow path.

19. The vehicle exhaust system of claim 1 wherein the diverted flow (DF) flows through the reservoir in a circumferential direction with respect to the primary exhaust gas flow path.

* * * * *